US005848501A

United States Patent [19]

Taipale et al.

[11] Patent Number: 5,848,501

[45] Date of Patent: Dec. 15, 1998

[54] MODULAR PORTABLE SYSTEM

[75] Inventors: Dale L. Taipale, Waseca; Michael D. Jines, Owatonna; Grant S. Quam, Owatonna, all of Minn.

[73] Assignee: Wenger Corporation, Owatonna, Minn.

[21] Appl. No.: 350,667

[22] Filed: Dec. 7, 1994

Related U.S. Application Data

[63] Continuation of Ser. No. 923,733, Jul. 31, 1992, abandoned.

[51] Int. Cl.[6] ..... E04B 2/82

[52] U.S. Cl. ..... 52/126.4; 52/263; 52/299; 52/126.6; 52/183; 52/7

[58] Field of Search ..... 52/6, 7, 126.4–126.6, 52/127.7, 175, 183, 263, 299, 474, 766, 767; 248/178, 180, 186, 188; 403/49

[56] References Cited

U.S. PATENT DOCUMENTS

| | | | |
|---|---|---|---|
| 284,418 | 6/1883 | Tseng | D34/32 |
| 300,073 | 2/1884 | Crump | D34/32 |
| D. 304,499 | 11/1989 | Rogers et al. | D25/62 |
| 2,894,709 | 7/1959 | Aunari | 248/186 |
| 3,084,911 | 4/1963 | Spiselman . | |
| 3,094,848 | 6/1963 | Albrecht | 52/263 |
| 3,100,624 | 8/1963 | Spiselman . | |
| 3,150,748 | 9/1964 | Liskey, Jr. | 52/126.6 X |
| 3,157,254 | 11/1964 | Spiselman et al. . | |
| 3,181,203 | 5/1965 | Wenger | 52/6 |
| 3,425,179 | 2/1969 | Haroldson | 52/283 |
| 3,470,663 | 10/1969 | Tate | 52/126 |
| 3,599,382 | 8/1971 | Stone, Jr. | 52/175 |
| 3,606,704 | 9/1971 | Denton | 52/126.6 X |
| 3,964,402 | 6/1976 | Jenne et al. | 108/64 |
| 4,009,550 | 3/1977 | Young | 52/127.7 X |
| 4,044,523 | 8/1977 | Layher | 52/638 |
| 4,050,257 | 9/1977 | Parks et al. | 52/263 X |
| 4,180,342 | 12/1979 | Layher | 403/24 |
| 4,278,031 | 7/1981 | Dangschat | 248/180 X |
| 4,301,627 | 11/1981 | Wilson | 52/6 |
| 4,394,095 | 7/1983 | Layher | 403/49 |
| 4,426,171 | 1/1984 | Layher | 403/49 |
| 4,485,598 | 12/1984 | Gaurdiani | 52/299 |
| 4,558,544 | 12/1985 | Albrecht et al. | 52/126.6 |
| 4,603,756 | 8/1986 | Layher | 182/178 |
| 4,630,417 | 12/1986 | Collier | 52/126.4 X |
| 4,638,604 | 1/1987 | Rogers et al. | 52/6 |
| 4,650,145 | 3/1987 | Natzel et al. | 248/414 |

(List continued on next page.)

FOREIGN PATENT DOCUMENTS

| | | |
|---|---|---|
| 2350452 | 12/1977 | France . |
| 2418319 | 9/1979 | France . |
| 1659314 | 9/1971 | Germany . |
| 3515491 | 10/1986 | Germany . |
| 755735 | 8/1956 | United Kingdom . |
| 2023204 | 12/1979 | United Kingdom . |

OTHER PUBLICATIONS

AlumiRamp, Inc. Advertisement.

Mountain Productions, Staging, Sound Wings & Towers Advertisement.

Stage Rite: Supporting The Performing Arts Advertisment.

*Primary Examiner*—Suzanne Dino Barrett
*Assistant Examiner*—Suzanne L. Dino
*Attorney, Agent, or Firm*—Patterson & Keough, P.A.

[57] ABSTRACT

A modular portable stage and floor system uses a small number of standardized modular components to construct a temporary or permanent platform that is easily adaptable to a wide variety of platform designs. The modular standardized components include a series of modular vertical and horizontal supports and a light-weight modular deck panel. The modular vertical and horizontal supports can be detachably coupled together in a slidably interlocked manner using a universal connector mechanism in to a support frame structure for supporting a plurality of modular deck panels. By using a small number of modular supports and a universal connector mechanism that is similar for all structural interconnections required to build the support frame structure, the modular portable stage and floor system is strong and stable, yet easily transported, assembled and disassembled.

34 Claims, 20 Drawing Sheets

U.S. PATENT DOCUMENTS

| | | | |
|---|---|---|---|
| 4,685,258 | 8/1987 | Av-Zuk | 52/299 X |
| 4,759,162 | 7/1988 | Wyse | 52/183 X |
| 4,768,617 | 9/1988 | Mason et al. | 182/1 |
| 4,779,542 | 10/1988 | Staten et al. | 108/112 |
| 4,811,530 | 3/1989 | Eyerly | 52/263 X |
| 4,825,976 | 5/1989 | Wyse | 182/222 |
| 4,843,792 | 7/1989 | Rogers et al. | 52/127.7 |
| 4,845,915 | 7/1989 | Rogers et al. | 52/783 |
| 4,901,490 | 2/1990 | Zinniel et al. | 52/263 |
| 4,912,887 | 4/1990 | Sullivan | 52/7 |
| 4,917,217 | 4/1990 | Rogers et al. | 52/7 |
| 4,919,230 | 4/1990 | Langer et al. | 182/179 |
| 4,922,670 | 5/1990 | Naka et al. | 52/263 X |
| 4,930,277 | 6/1990 | Krumholz et al. | 52/263 |
| 4,941,763 | 7/1990 | Euteneuer | 403/3 |
| 4,949,649 | 8/1990 | Terres et al. | 108/116 |
| 4,959,935 | 10/1990 | Stob | 52/183 |
| 4,979,340 | 12/1990 | Wilson et al. | 52/9 |
| 4,988,131 | 1/1991 | Wilson et al. | 292/34 |
| 5,022,200 | 6/1991 | Wilson et al. | 52/127.9 |
| 5,046,879 | 9/1991 | Langer nee Lahyer | 403/49 |
| 5,050,353 | 9/1991 | Rogers et al. | 52/8 |
| 5,117,596 | 6/1992 | Leslie et al. | 52/126.6 |
| 5,152,109 | 10/1992 | Boers | 52/6 X |
| 5,157,890 | 10/1992 | Jines | 52/584 |
| 5,177,913 | 1/1993 | Erel | 52/175 X |
| 5,230,491 | 7/1993 | Tseng | 248/188 X |
| 5,301,480 | 4/1994 | Oyama et al. | 52/126.6 |

MODULAR PORTABLE SYSTEM

This application is a file-wrapper-continuation of Ser. No. 07/923,733, filed Jul. 31, 1992, abandoned.

TECHNICAL FIELD

The present invention relates generally to portable staging systems for providing temporary or permanent platforms for theatrical or musical events, for example. More particularly, the present invention relates to a modular portable stage and floor system that uses modular vertical and horizontal supports that are detachably coupled together in a slidably interlocked manner using a universal connector mechanism to provide a support frame structure for supporting a plurality of modular deck panels such that the staging system is strong and stable, yet easily transported, assembled and disassembled.

BACKGROUND ART

Various types of portable staging and flooring systems exist for providing temporary platforms. These temporary platforms are usually intended to serve as stages or stage extensions for theatrical or musical events, or as elevated floors or platforms above the permanent floor of an indoor facility or above the ground outside.

Most prior art portable staging and flooring systems fall into one of three categories—unitary portable platforms, collapsible portable platforms and assembled portable platforms. Unitary portable platforms are typically comprised of a single permanently assembled structure that folds together and includes a set of wheels to transport the unit, as shown, for example, in U.S. Pat. Nos. 4,949,649 and 4,917,217. Collapsible portable platforms are typically comprised of multiple permanently assembled structures that can be interconnected as an arrangement of separate free-standing units, each of which is designed to collapse for easy storage and transportation, as shown, for example, in U.S. Pat. No. 5,050,353. Assembled portable platforms, on the other hand, are comprised of many separate components that are temporarily assembled together, as shown, for example, in U.S. Pat. Nos. 4,930,277, 4,988,131 and 4,638,604. Although unitary portable platforms are typically simple to assemble and easily transported, they are usually very limited in the amount of platform space that is provided and in the manner in which that space is arranged. In contrast, collapsible portable platforms and assembled portable platforms can typically be arranged to provide larger areas of platform space configured in a variety of different floor plan arrangements.

Unfortunately, current collapsible portable stages and floors and assembled portable stages and floors have several problems that detract from their ease of installation and use, and limit their effectiveness under certain situations. In particular, current portable platforms are not well suited for heavy duty usage. Existing portable platforms have a difficult time providing sturdy and stable platforms that are capable of supporting heavy equipment or withstanding significant vibrational energy, as may be encountered, for example, in staging a rock concert. Those portable stages and floors that can support heavy duty usage often require mechanical assistance in transporting some of the various components of the system, as well as a crew of skilled technicians in order to assemble a large variety of sometimes complicated components. Finally, the adaptability of current portable stages and floors to complicated floor plans is limited, and significant planning and preparation may be required in order to accommodate multi-level platform areas of a variety of floor plan arrangements.

In the case of collapsible portable stages and floors, these problems are difficult to overcome because of the structural limitations imposed on the size and weight of each of the separate free-standing units. In order to support heavy duty usage, a certain mass of support material is required. When this amount of support material is built into each free-standing unit, however, the overall weight of the free-standing units quickly surpasses the desired weight for a truly portable staging and flooring system.

The major problem with current assembled portable stages and floors is that proper assembly of the portable platform is not easy, either in terms of planning the flooring arrangement, or in terms of assembling and disassembling the system. The tools and expertise necessary to assemble such staging and flooring systems can be considerable. With the advent of stricter governmental standards for these types of structures in terms of safety and accessibility by the disabled, the design and construction of such assembled portable stages and floors can require significant effort from both engineers and professional construction workers.

Although current portable staging and flooring systems are useful in many situations where temporary platforms are required, it would be desirable to provide a portable staging and flooring system that could overcome the limitations and problems of current portable systems. Moreover, it would be advantageous to provide a portable staging and flooring system that is well suited for heavy-duty usage, and is also easily adaptable to a wide variety of platform designs, while at the same time being simple to transport, assemble and disassemble.

SUMMARY OF THE INVENTION

The present invention provides a modular portable stage and floor system that uses a small number of standardized modular components to construct a temporary platform that is easily adaptable to a wide variety of platform designs. The modular standardized components include a series of modular vertical and horizontal supports that are detachably coupled together in a slidably interlocked manner using a universal connector mechanism to provide a support frame structure for supporting a plurality of modular deck panels. By using a small number of modular supports and a universal connector mechanism that is similar for all structural interconnections required to build the support frame structure, the modular portable stage and floor system is strong and stable, yet easily transported, assembled and disassembled.

Unlike current assembled portable stage and floor systems, the modular portable system of the present invention does not require special tools or expertise in order to assemble or disassemble. The same type of universal connector mechanism is used to slidably interconnect a vertical support to one or more horizontal supports, or a horizontal support to one or more other horizontal supports, without the need for any tools. Also unlike most current assembled portable stage and floor systems, the modular deck panels of the present invention are not part of the support frame structure. Instead, a series of unique horizontal supports provide both the horizontal support between two or more vertical supports and the vertical support for one or more modular deck panels. The unique design of the horizontal supports of the present invention is strong enough to span the length of multiple deck panels without requiring a vertical support at each corner of every deck panel. The use of the unique horizontal supports of the present invention eliminates the need for angular bracing or cabling as part of the support frame structure, and also allows for open access underneath the support frame structure to store equipment and other items below the modular portable stage and floor system, for example.

The universal connector mechanism of the preferred embodiment of the present invention is comprised of a male fitting located on one of the modular support components and a compatible female receptor located on the other modular support component to be detachably interconnected. The male fitting is slidably interlocked with the female receptor to horizontally couple the two modular support components. The male fitting is vertically supported by a stop ledge at the base of the female receptor. In the preferred embodiment, the interlocking of the male fitting with the female receptor of the universal connector mechanism is actuated by a fail safe shim mechanism to provide a secure vibration resistant mating between the two modular support components.

The modular horizontal supports of the preferred embodiment of the present invention are each comprised of upper and lower longitudinal periphery members that are vertically separated at each end by the female receptor of the universal connector mechanism and permanently connected thereto. The female receptor includes the operational part of the fail safe shim mechanism in the preferred embodiment. To provide additional structural support, a vertical web panel is also interposed between the upper and lower periphery members. In the preferred embodiment, the upper and lower periphery members are also formed so as to allow for the detachable engagement of a variety of staging accessories, such as stairs, ramps, guardrails, step adapters, skirting, etc. For those horizontal supports which span more than the length of a single square deck panel, one or more additional universal connector mechanisms are added to allow for a second horizontal support to be detachably connected between the instant horizontal support and a third horizontal support. In the preferred embodiment of the modular stage system of the present invention, each horizontal support has a male fitting permanently connected along the length of each horizontal support member at intervals corresponding to the dimension of the side of the square deck panel so that different types of horizontal supports are not required.

The modular vertical support of the preferred embodiment of the present invention can be one of three standardized versions—a fixed length vertical support, an infinitely adjustable vertical support and a telescoping vertical support. Each type of vertical support is provided with a common adjustable foot portion having a sliding portion and a ground engaging portion that cooperate to allow for the leveling of the base of the vertical support to the floor or ground. The infinitely adjustable vertical support is provided with an infinite fine adjustment mechanism between the foot portion and the lower end of the vertical support that mates in a screw-like manner with a rotatable bit to allow for infinite adjustments to the height of the vertical support. The telescoping vertical support includes both the infinite fine adjustment mechanism and a step gross adjustment mechanism.

The step gross adjustment mechanism is comprised of a plurality of concentrically sized vertical segments each having a rotatable collar that can be rotated to engage with two or more step support collars on the adjacent vertical segment immediately below the instant vertical segment. In the preferred embodiment, an actuating lever engages a set of teeth on the rotatable collar to engage or disengage the operation of the rotatable collar with the support collars. A vertical support extension coupler is also provided that uses the same universal connector mechanism to allow for the stacking of two or more vertical supports.

The modular deck panels of the preferred embodiment of the present invention are square sheets of decking material that are reversible. Each deck panel is vertically supported around the periphery of the lower surface of the deck panel by the upper periphery member of two or more horizontal supports. The deck panels are placed into position once the frame support structure has been assembled. To secure the deck panels in place in the preferred embodiment, a deck panel locking mechanism is used that detachably engages with a channel in the upper periphery member of the horizontal supports, or a top plate of the vertical supports. The deck panel locking mechanism can be positioned at the conjuncture of the corners of two or more deck panels and has a plurality of spring-biased fingers that cooperate with the upper periphery member and a corner brace on the corner of each of the deck panels to secure the deck panels to the support frame structure. The deck panel locking mechanism can be removed by turning a screw located in the top of the deck panel locking mechanism that retracts the spring-biased fingers, thereby allowing the deck panel locking mechanism to be lifted out of the upper periphery member.

In the preferred embodiment, the standardized modular supports, including the universal connector mechanism and the deck panel locking mechanism, are made of extruded aluminum, and the modular deck panels are each made of a 4'×4' square sheet of a lightweight honeycomb material that is heat-treated and surrounded along the periphery edge with an aluminum cladding connected at each corner with a corner brace. When placed on the assembled support frame structure, each modular deck panel of the preferred embodiment is rated for a load carrying capacity of 125 lbs/sq. ft.

Each feature of the preferred embodiment of the present invention is in compliance with the regulations regarding platform structure that have been promulgated under the Americans with Disabilities Act of 1992 ("ADA"). For example, the unique attachable stairway provides for an equal rise for each step, with closed risers and an even level railing. The attachable stairway of the present invention utilizes a ground level pivot point and a uniquely arranged four bar mechanism to provide a pivotable riser panel and railing to allow for variable height adjustments to the stairway without bringing the stairway out of compliance with the regulations. In a similar manner, the unique attachable ramp also provides for an adjustable legless ramp that operates within the proscribed rise/run regulations for such ramps and includes an even level railing.

Accordingly, it is a primary objective of the present invention to provide a modular portable stage system that is simple to transport and does not require special tools or expertise in order to assemble or disassemble.

It is another primary objective of the present invention to provide a modular portable stage system that is well suited for heavy-duty usage, and is also easily adaptable to a wide variety of platform designs.

It is a further primary objective of the present invention to provide a modular portable stage system that uses a small number of modular supports and a universal connector mechanism for all structural interconnections required to build the support frame structure for the stage system.

It is a still further primary objective of the present invention to provide a modular portable stage system that is in compliance with the regulations regarding platform structure that have been promulgated under the ADA.

Another objective of the present invention is to provide a unique horizontal support for a modular portable stage system that is strong enough to span the length of multiple deck panels without requiring a vertical support at each corner of every deck panel.

A further objective of the present invention is to provide a unique horizontal support for a modular portable stage system that eliminates the need for angular bracing or cabling as part of the support frame structure, and also allows for open access underneath the support frame structure to easily store equipment and other items below the modular portable stage system.

A still further objective of the present invention is to provide a unique adjustable stairway and ramp that are in compliance with the regulations regarding platform structure that have been promulgated under the ADA.

These and other objectives of the present invention will become apparent with reference to the drawings, the detailed description of the preferred embodiment and the appended claims.

DETAILED DESCRIPTION OF THE DRAWINGS

Figure 1:
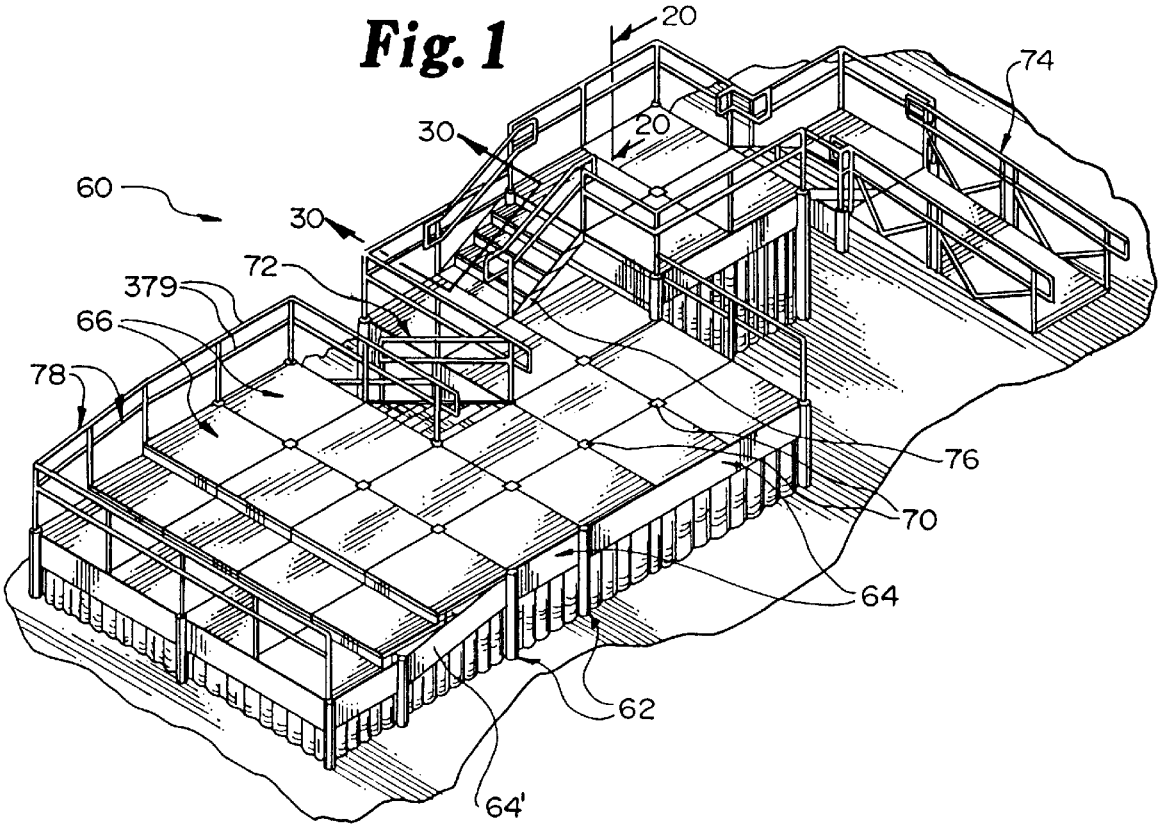
FIG. 1 is an overall perspective view of a fully assembled modular stage and floor system in accordance with the present invention depicting a suggested floor plan.
Figure 44:
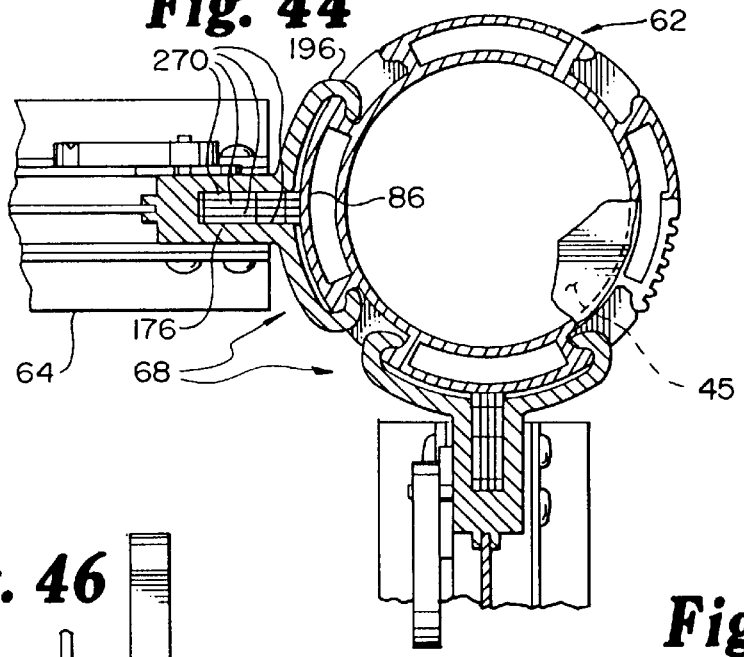
FIG. 44 is a fragmentary, top plan view depicting a vertical support having a pair of intersecting horizontal supports matingly coupled thereto.
Figure 46:
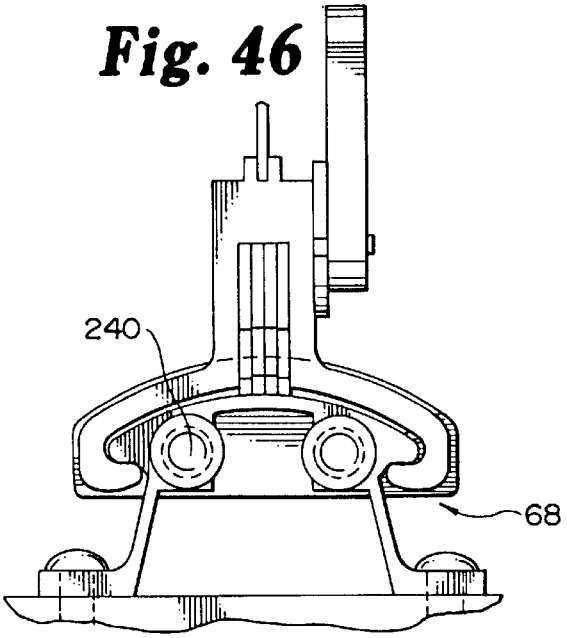
FIG. 46 is a fragmentary, top plan view of a first horizontal support member coupled to a second horizontal support member via a universal connector.

Referring to the drawings, a fully assembled modular portable stage and floor system 60 is depicted in FIG. 1, it being understood that the floor plan of FIG. 1 is only one of many possible floor arrangements. The stage and floor system 60 broadly includes modular vertical support 62, modular, horizontal supports 64, modular floor panel 66, universal connectors 68 (discussed in conjunction with FIGS. 44 and 48), and floor locking mechanisms 70. As depicted in FIG. 1, the modular portable stage and floor system 60 can also include an adjustable stairway assembly 72, an access ramp 74, floor step adaptor 76, and attachable guardrails 78.

Figure 2:
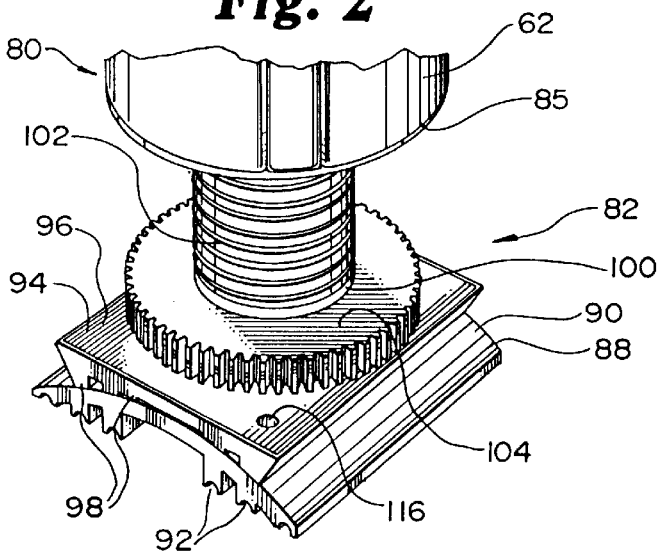
FIG. 2 is a fragmentary, perspective view depicting the foot portion of a modular vertical support in accordance with the present invention.
Figure 7:
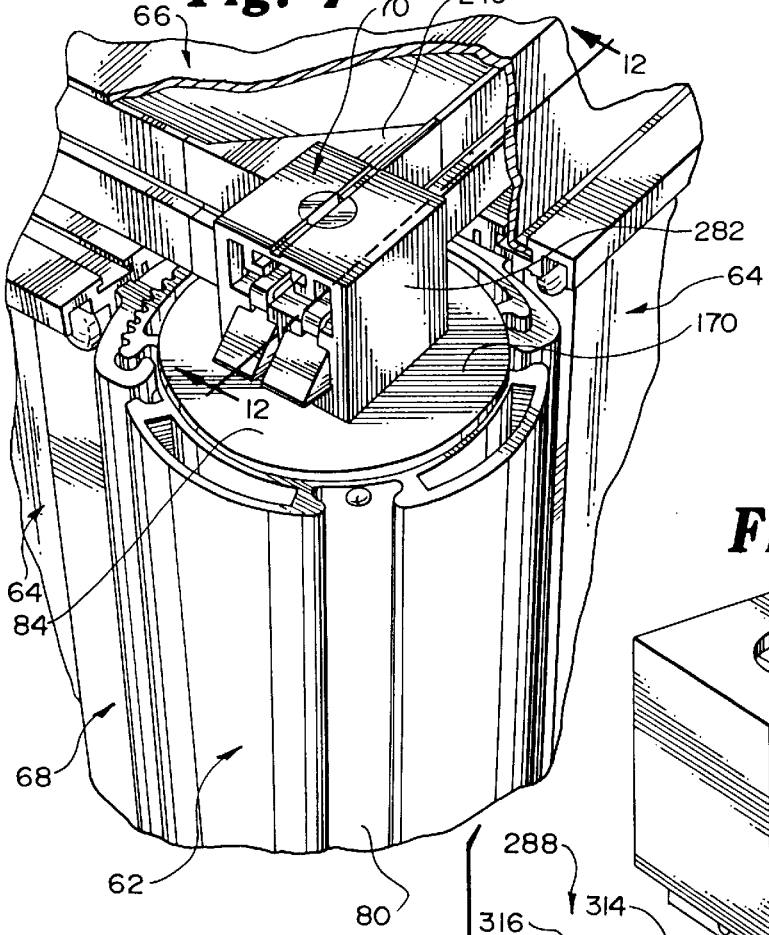
FIG. 7 is a fragmentary, perspective view of a corner of the assembled modular stage and floor system depicting in particular a floor panel locking mechanism carried on the upper surface of a vertical support.
Figure 8:
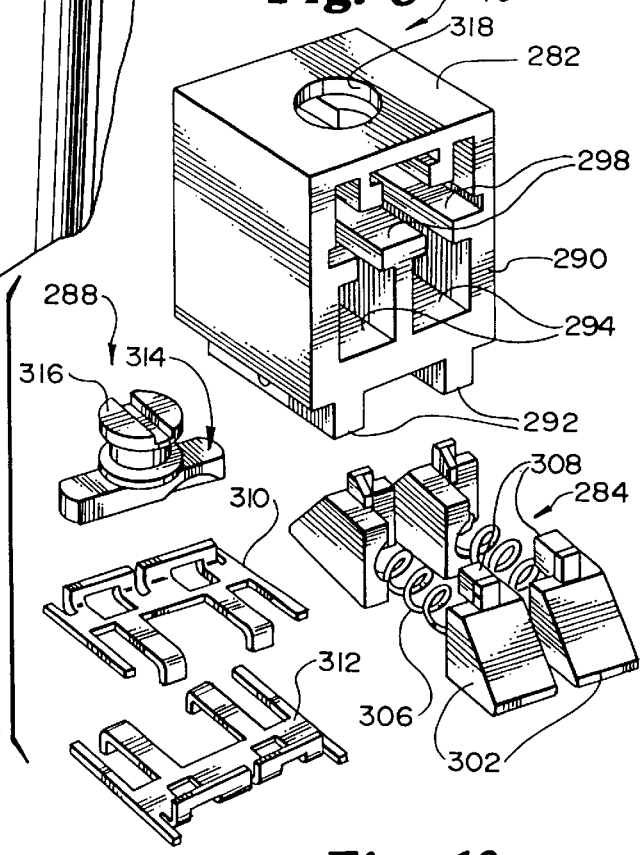
FIG. 8 is an exploded perspective view of a floor panel locking mechanism.
Figure 18:
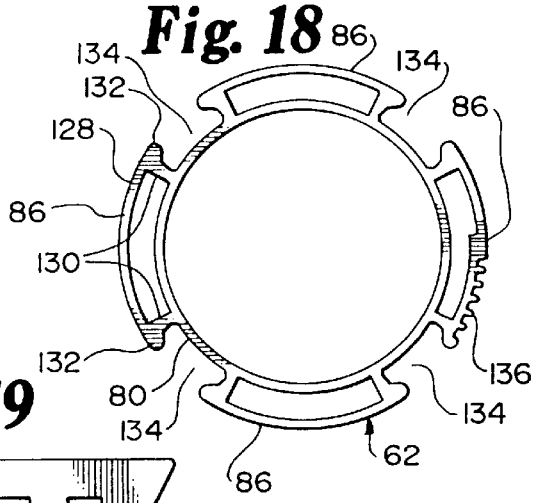
FIG. 18 is a top plan view of a vertical support with the top plate thereof removed.
Figure 19:
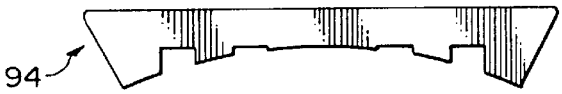
FIG. 19 is an elevational view of the slidable plate of the foot portion of a vertical support.
Figure 20:
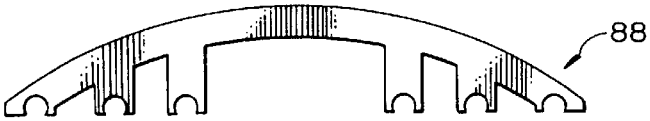
FIG. 20 is an elevational view of the ground engaging plate of the foot portion of a vertical support.

Referring to FIGS. 2, 7, and 18, each vertical support 62 includes a generally tubular leg 80 (FIG. 7), having a lowermost foot portion 82 (FIG. 2), and an uppermost top plate 84 (FIG. 7) and bottom plate 85 (FIG. 2) carried by the leg 80. Four male fittings 86 (FIG. 18) of the universal connector 68 (discussed in conjunction with FIGS. 44 and 48) are integrally carried along the outer surface of the vertical support tubular leg 80.

Figure 6:
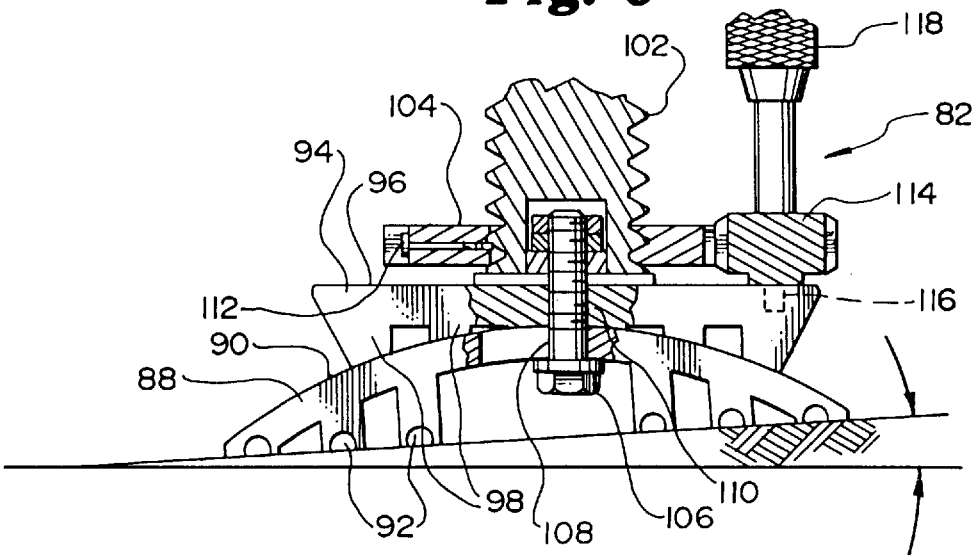
FIG. 6 is a fragmentary, front elevational view of the foot portion of a vertical support with parts thereof cut away for clarity and with an adjustment bit received thereon.

The structure of foot portion 82 of the vertical support 62 is best understood with reference to FIGS. 2, 6, 19 and 20. A foot portion 82 includes a lowermost, ground engaging plate 88 having an upwardly facing arcuate surface 90, and a plurality of lowermost, generally parallel tread ribs 92. A slide plate 94 is shiftably carried along the upper surface 90 of the ground engaging plate 88 to allow leveling of the slide plate 94 relative to the ground engaging plate 88, as depicted in FIG. 6. The slide plate 94 includes an uppermost generally planar surface 96 and a plurality of generally parallel, ground engaging ribs 98 that present a matching profile to the upper surface 90 of the ground engaging plate 88.

Figure 3:
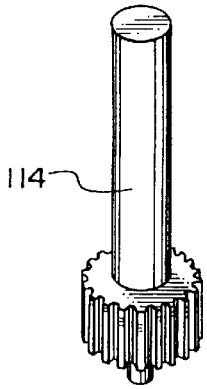
FIG. 3 is a perspective view of an adjustment bit mateable with the foot portion depicted in FIG. 2, for rotation of the infinite adjustment mechanism of the foot portion.

An infinite adjustment mechanism 100 is interposed between the lower end of the tubular leg 80 and the slide plate 94. Infinite adjustment mechanism 100 includes threaded post 102 and lowermost gear 104. The post 102 is threadably received within the lower plate 85 of leg 80, and is extendable and retractable relative to the leg when rotated. Referring to FIG. 6, attachment bolt 106 extends through an elongated slot 108 in the ground engaging plate 88, a circular in cross section aperture 110 in the slide plate 94 and is received within the threaded post 102. The gear 104 is fixedly coupled to the threaded post 102 with, for instance, a set screw 112. An adjustment bit 114, as shown in FIG. 3 and FIG. 6, can be received within aperture 116 of slide plate 94 in gear engaging relationship with the gear 104 of infinite adjustment mechanism 100. The adjustment bit 114 can be rotated by an electric drill or similar rotational tool 118 as depicted in FIG. 6, causing the threaded post 102 to rotate. It will be understood that a vertical support 62 can be provided without the infinite adjustment mechanism 100 to provide a fixed length vertical support.

Figure 9:
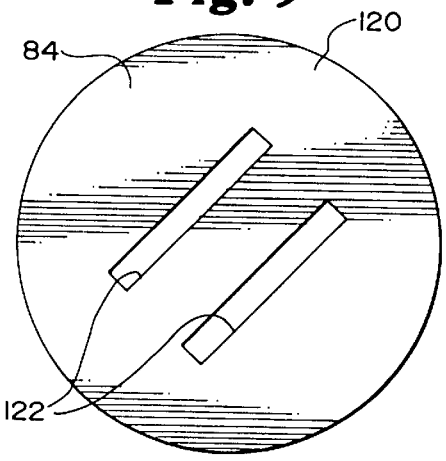
FIG. 9 is a top plan view of a vertical support upper plate.
Figure 10:
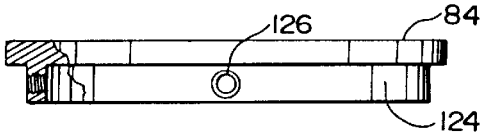
FIG. 10 is a side elevational view of the support plate depicted in FIG. 9, with portions cut away for clarity.
Figure 11:
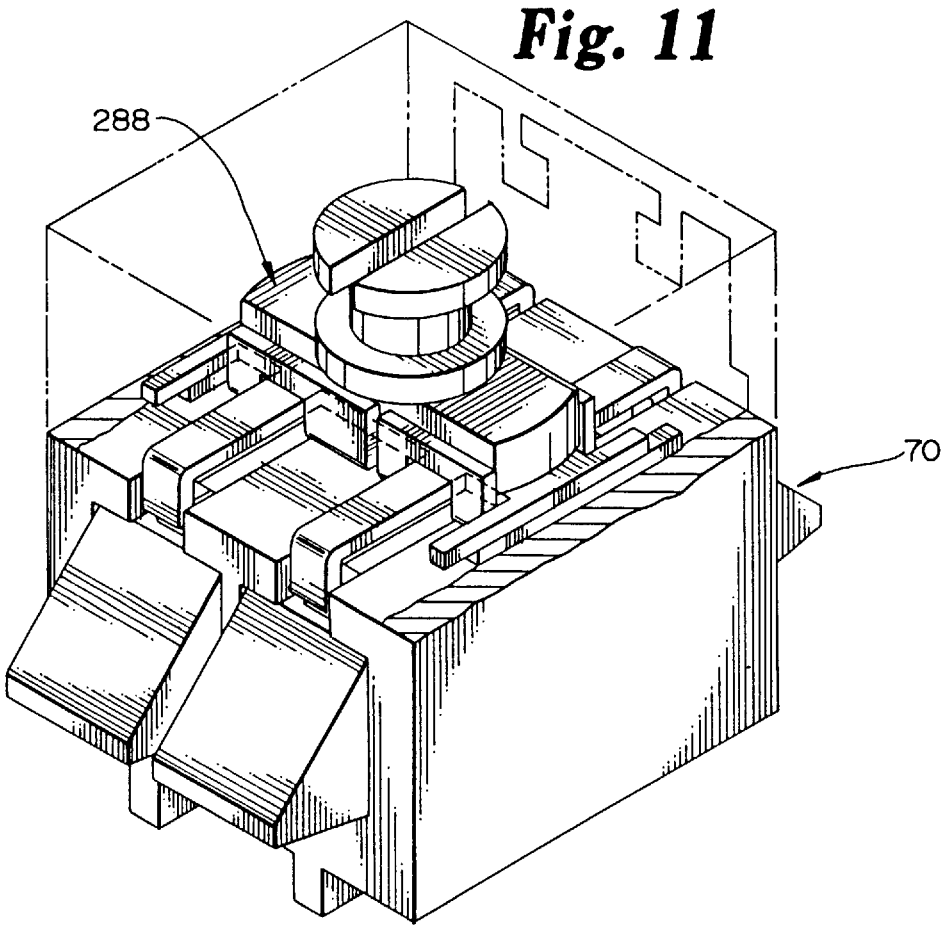
FIG. 11 is a perspective view of a floor panel locking mechanism with parts cut away for clarity, and phantom lines depicting the periphery of the cut away parts.

Referring to FIGS. 9 and 10, the top plate 84 of vertical support 62 includes an upper, generally planar surface 120 having a pair of parallel, locking mechanism receiving slots 122 therein. Generally circular ring 124 extends downwardly from the upper surface 120 of top plate 84 for receipt inside the tubular leg 80 of vertical support 62 (FIG. 7). Set screws 126 hold the top plate 84 in place. The bottom plate 85 (FIG. 2) can be received within the lower end of the tubular leg 80 in a similar manner.

Figure 45:
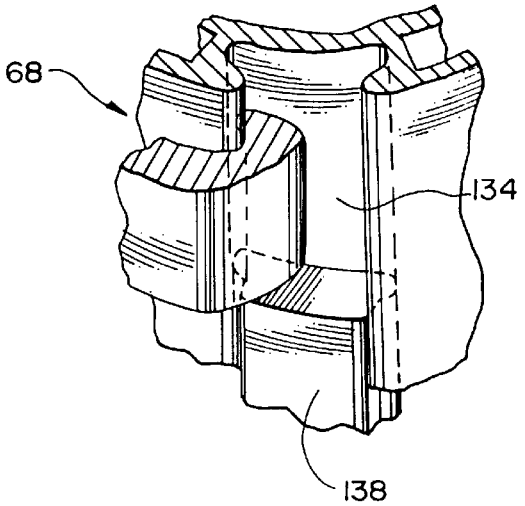
FIG. 45 is a fragmentary, perspective view taken at 45 of FIG. 44.

Referring in particular to FIG. 18, four male fittings 86 of universal connector 68 are oriented about the tubular leg 80 of the vertical support 62 at 90° intervals. Each fitting 86 extends along the length of the tubular leg 80 and includes an outermost, arcuate surface 128, and opposed, inset support walls 130 coupling the arcuate surface 128 to the tubular leg 80, presenting, in cooperation with the arcuate surface 128, opposed engagement margins 132. The engagement margins 132 and support walls 130 of the male fittings 86 oriented about the tubular leg 80 of vertical support 62 present four, generally angularly equally spaced slots 134. One of the arcuate surfaces 128 of the male fittings 86 includes a series of parallel ribs and grooves 136 to provide a gear engaging surface along a portion of the arcuate surface 128. Referring to FIG. 45, a longitudinal spacer bar 138 is receivable within slots 134. The spacer bars 138 can be held in place within the slots by a thermally treated force fit, or by the abutment of the lower end of the spacer bar 138 with the bottom plate 85 of the vertical support. The upper surface of the spacer bar 138 provides an engagement surface for supporting the female receptor 196 (FIG. 17) of a universal connector 68 at a desired height.

As described above, the vertical support 62 can be provided in a fixed length, or in a variation having a fine, infinite adjustment feature. A third version of the vertical support 62', having a telescoping feature to provide a stepped, gross height adjustment is depicted in FIGS. 35–41. The telescoping version of the vertical support broadly includes a tubular leg 80' similar to the tubular leg 80 described above, but with a locking collar 140 carried at the lower end of the leg 80'. An extension column 142 is slidably received within the tubular leg 80'. The remaining portions of the telescoping version of the vertical support 62' are identical to the structure described above for the nontelescoping versions of the vertical support 62, and are annotated with identical numbers.

The extension leg 142 (FIG. 35) includes a tubular support wall 144 and a plurality of outwardly extending, generally rectangular in cross section ribs 146. The ribs 146 define a plurality of longitudinally extending grooves 148. A series of longitudinally spaced apart circumferential grooves 152 separate each rib 146 into a plurality of longitudinal rib portions 153.

Figure 38:
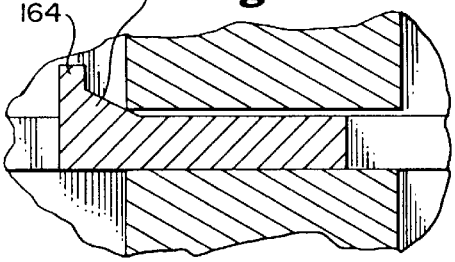
FIG. 38 is an enlarged, sectional view taken along the line 38—38 of FIG. 36.
Figure 35:
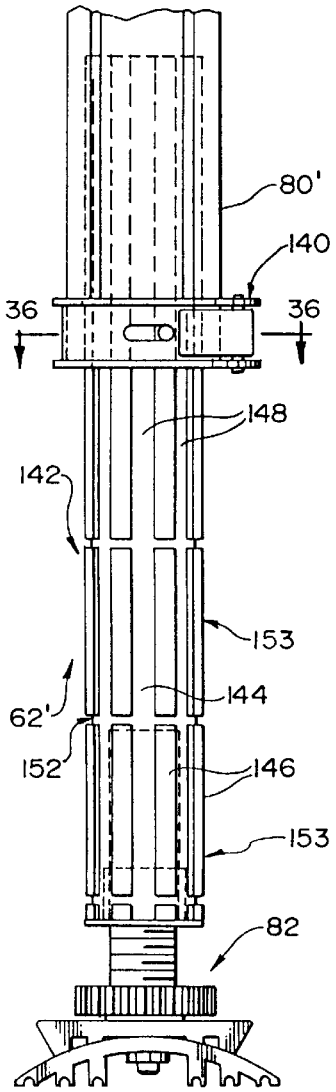
FIG. 35 is a fragmentary, elevational view of a telescoping vertical support of the modular portable stage and floor system in accordance with the present invention.
Figure 41:
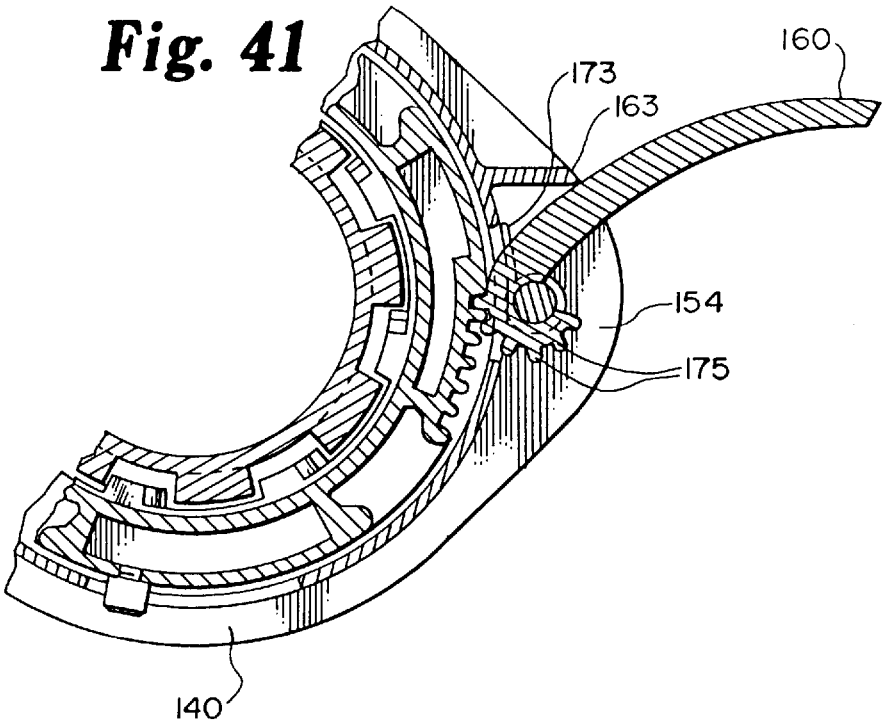
FIG. 41 is a fragmentary, sectional view taken along the line 36—36 of FIG. 35 depicting the actuating lever in the extended position.
Figure 42A:
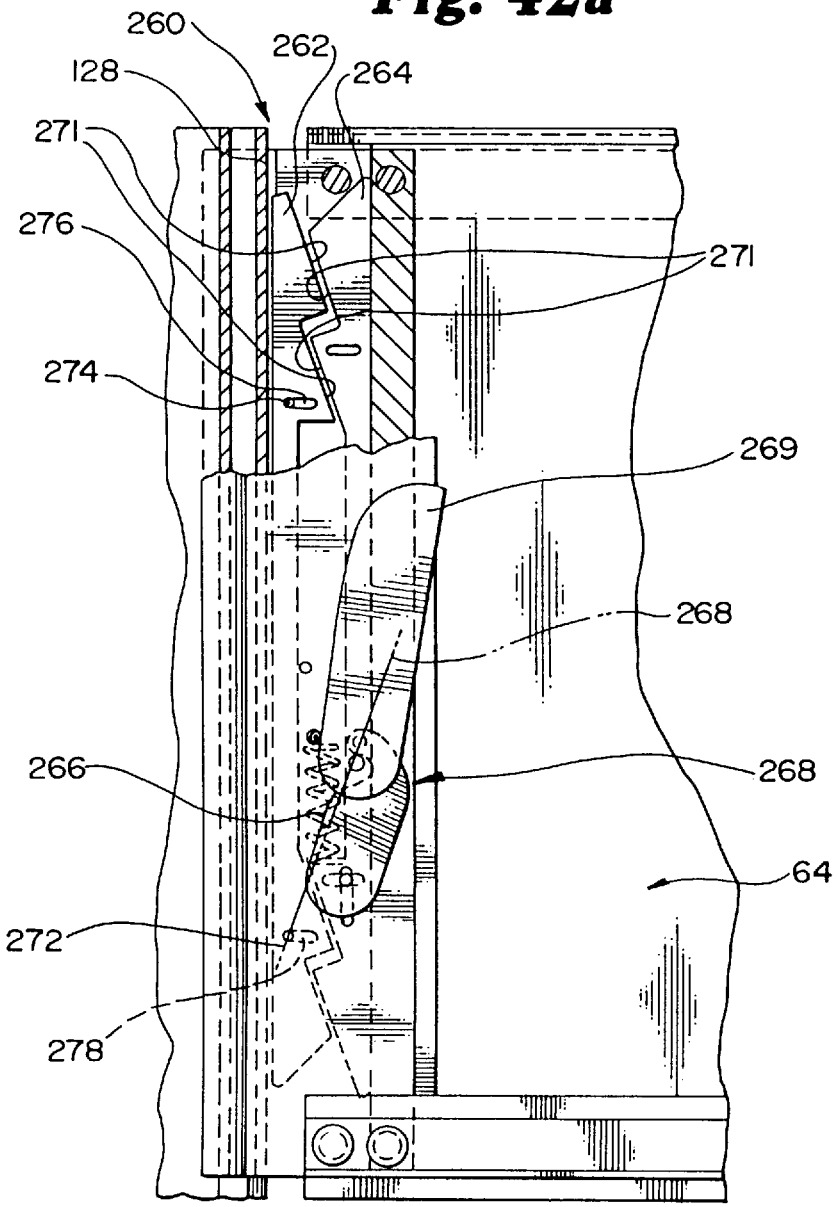
FIG. 42*a* is a fragmentary, elevational view of a horizontal support depicted as coupled with the male receptor of a universal connector, with parts cut away and parts shown in phantom lines to depict the shim mechanism of the horizontal support.
Figure 42B:
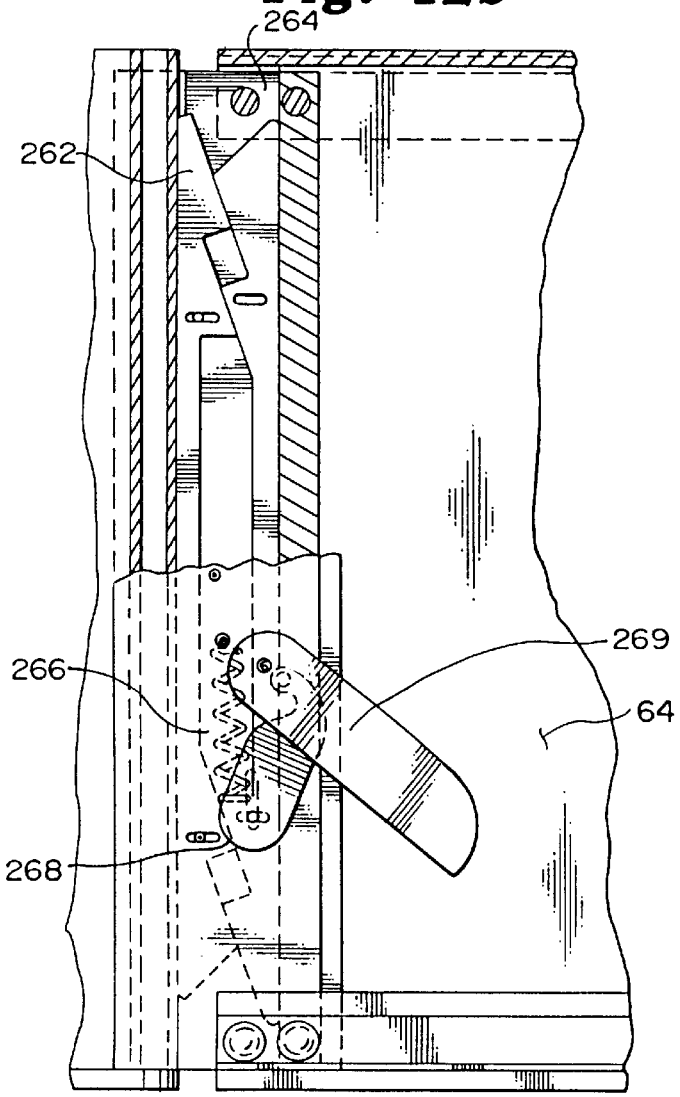
FIG. 42*b* is similar to 42*a* but with the shim mechanism depicted in the engaged position.

Locking collar 140 (FIG. 37) includes an outer support ring 154 and a locking washer 156 fixedly carried by the support ring 154. Locking washer 156 includes a plurality of radially, inwardly facing engagement teeth 158. An actuating lever 160 (FIG. 36) is pivotally coupled to the support ring 154 by pivot rod 162. Referring to FIG. 41, actuating lever engaging stop rib 163 extends generally radially outwardly from the support ring 154 to limit the range of motion of the actuating lever 160. Referring to FIG. 38, each of the engagement teeth 158 of locking washer 156 includes an upwardly facing stop boss 164 that includes sloped engagement surface 166. The support ring 154 is slidably, rotationally carried along tubular leg 80' by set pins 168 (FIG. 36) received through slots 170 in the support ring 154.

Figure 36:
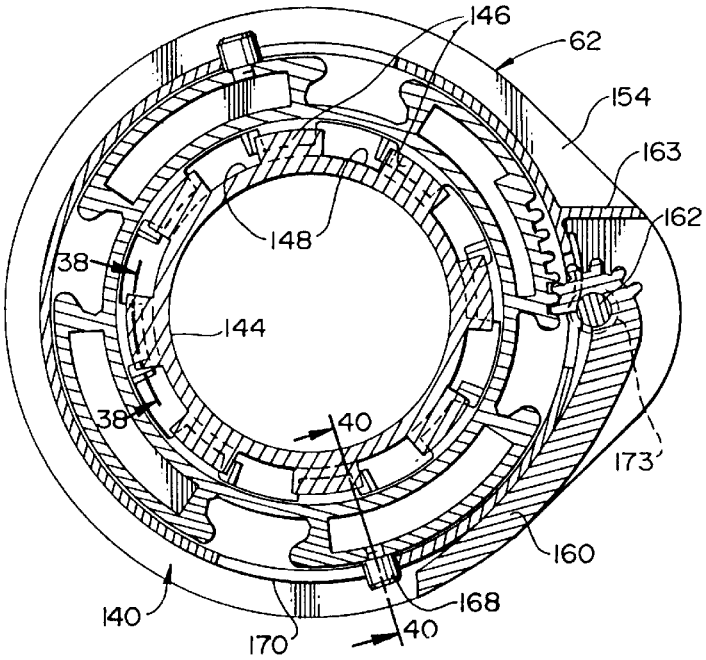
FIG. 36 is a sectional view taken along the line 36—36 of FIG. 35.
Figure 39:
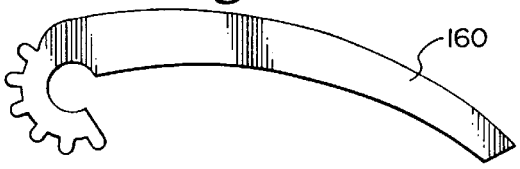
FIG. 39 is a top plan view of the actuating lever for the telescoping vertical support depicted in FIGS. 35–36.
Figure 40:
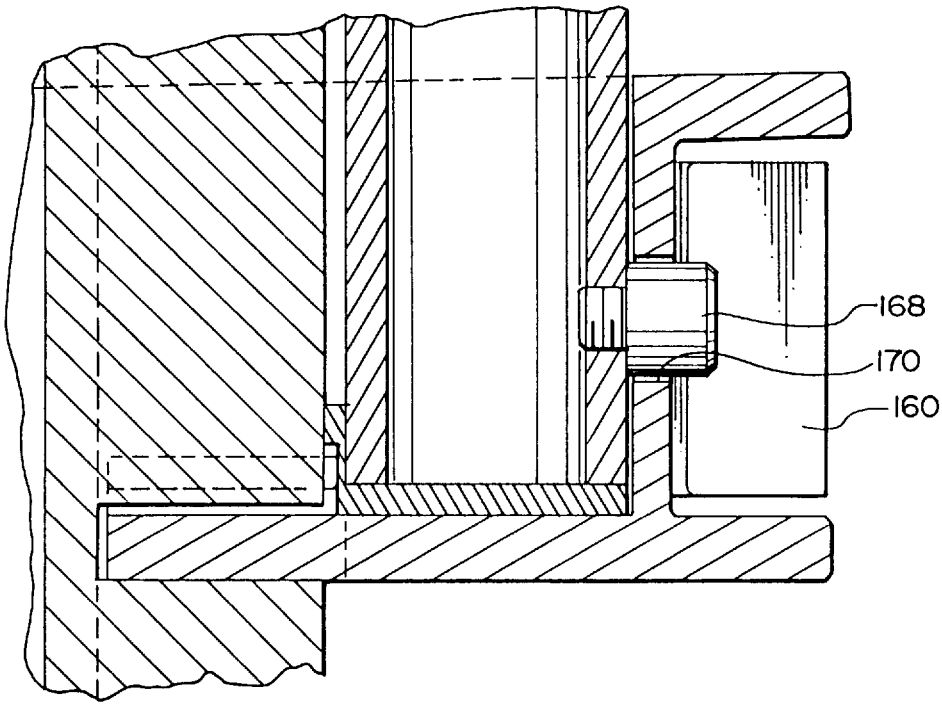
FIG. 40 is an enlarged, sectional view taken along the line 40—40 of FIG. 36.

It will be appreciated that the locking collar 140 can be rotated about the leg 80' by shifting the actuating lever 160 between the positions depicted in FIGS. 36 and 41. A spring 173 (FIG. 41) biases the lever 160 into the position depicted in FIG. 36. When in the position of FIG. 36, the engagement teeth 158 of locking collar washer 156 are in the position depicted in FIG. 35, interposed between rib portions 146 of extension leg 142. The tubular leg 80' is accordingly fixedly locked in vertical position with extension leg 142.

Shifting of lever 160 to the position depicted in FIG. 41 rotates the lever teeth 175 with the ribs and grooves 163 of male fitting 86 on leg 80'. Locking collar 140 accordingly is rotated relative to the leg 80', and engagement teeth 175 are disengaged from between rib portions 152 of extension leg 142, as depicted in FIG. 41. The teeth 175 are thereby free to shift along grooves 144 of extension leg 142, allowing the tubular leg 80' to shift upwardly or downwardly relative to extension leg 146.

Figure 58:
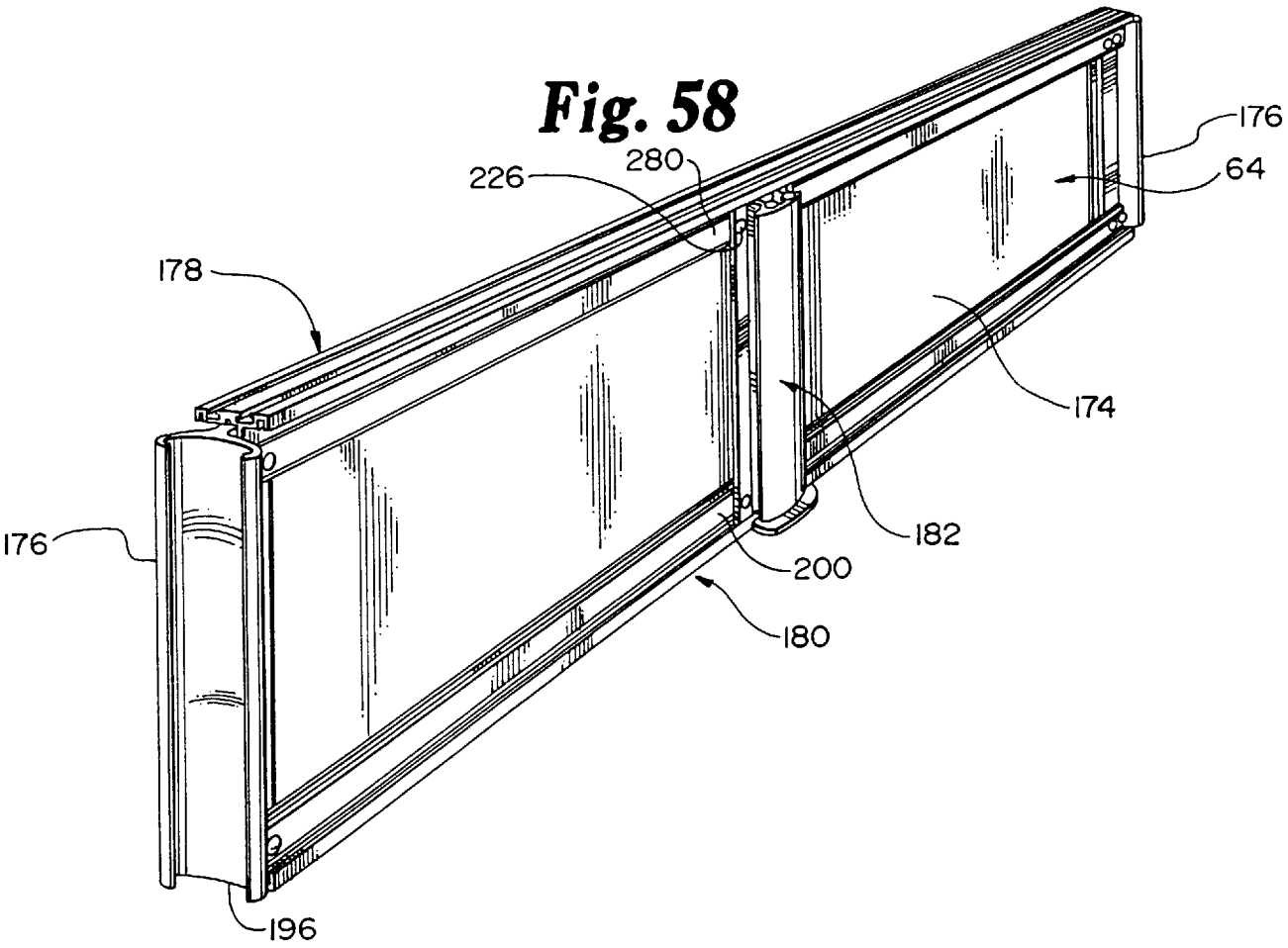
FIG. 58 is a perspective view of a horizontal support 64.

Referring to FIG. 58, each horizontal support 64 includes a load bearing support panel 174, opposed side fittings 176, and upper and lower longitudinal peripheral members 178, 180. An intermediate connector element 182, presenting the male fitting 86 (not shown) of a universal connector 68 (not shown), can be carried by the horizontal support 64 intermediate the side fittings 176.

Figure 16:
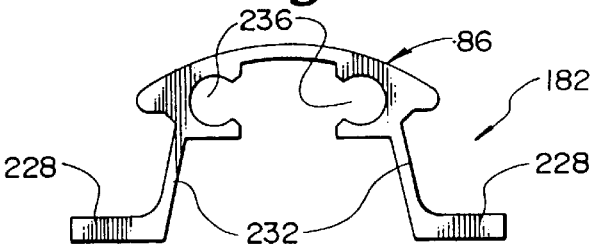
FIG. 16 is a top plan perspective view of the male fitting of a universal connector.
Figure 17:
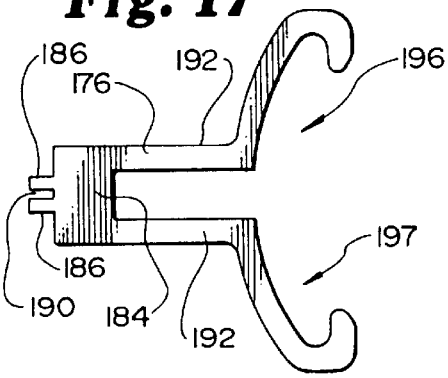
FIG. 17 is a top plan view of a female receptor of the universal connector.

Referring to FIG. 17, side fittings 176 comprise an integral piece having a base 184. A pair of parallel, outwardly extending ribs 186 define a side panel receiving groove 190. A pair of opposed arms 192 extend from the base 184 to define a female receptor 196 of the universal connector 68. The arms 192 define a receptor groove 197 that can receive a male fitting 86 (FIG. 16) in a complementary, interlocking fit.

Figure 15:
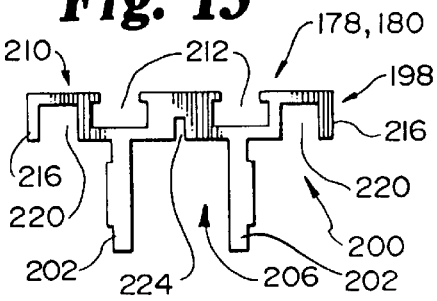
FIG. 15 is an end elevational view of a modular horizontal support upper peripheral member, it being understood that the horizontal support lower peripheral support is identical thereto.
Figure 23:
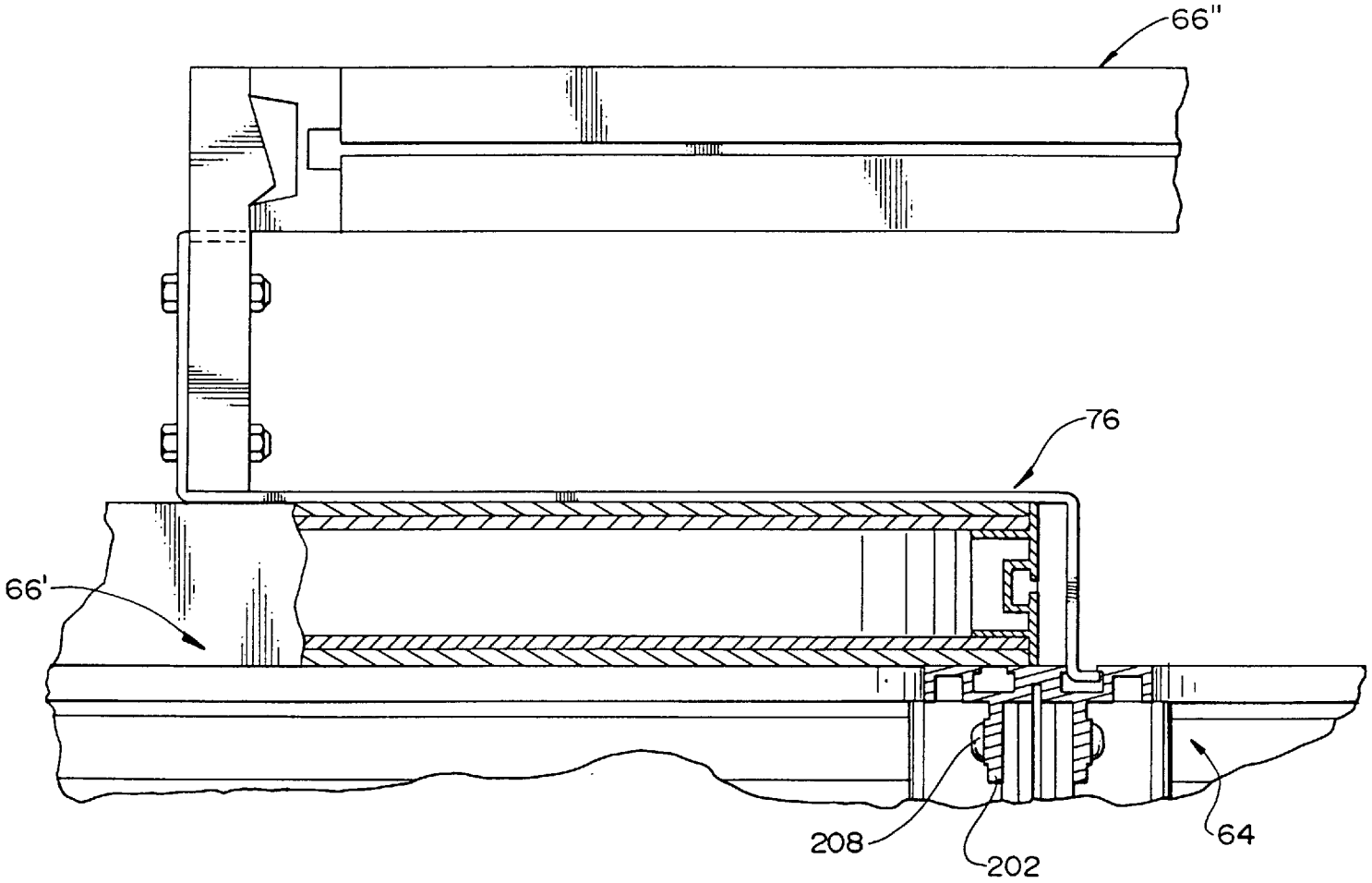
FIG. 23 is a fragmentary, elevational view depicting an upper modular floor panel oriented over a lower modular floor panel in a step orientation with parts cut away for clarity.

Referring to FIG. 15, the upper and lower longitudinal peripheral members 178, 180 of the horizontal support 64 (depicted in FIG. 58) comprise an integral piece presenting a floor panel engaging portion 198 and an attachment portion 200. The attachment portion 200 includes a pair of spaced apart ribs 202 presenting a clevis groove 206 that can receive the base 184 and arms 192 of a side fitting 176. Bolts or rivets 208, as can be seen in FIG. 23 for example, are received through the ribs 202 for attachment of the upper or lower longitudinal, peripheral member 178, 180 to the side fitting 176 (FIG. 58).

Figure 5:
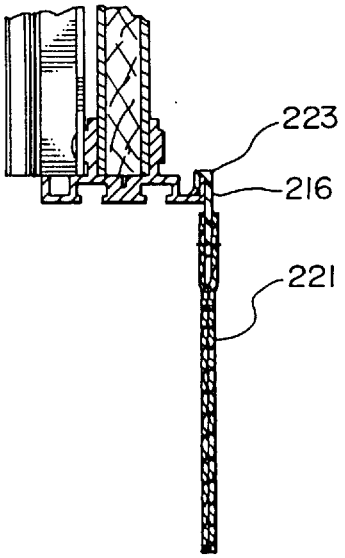
FIG. 5 is a fragmentary, sectional view taken along the line 5—5 of FIG. 4.
Figure 4:
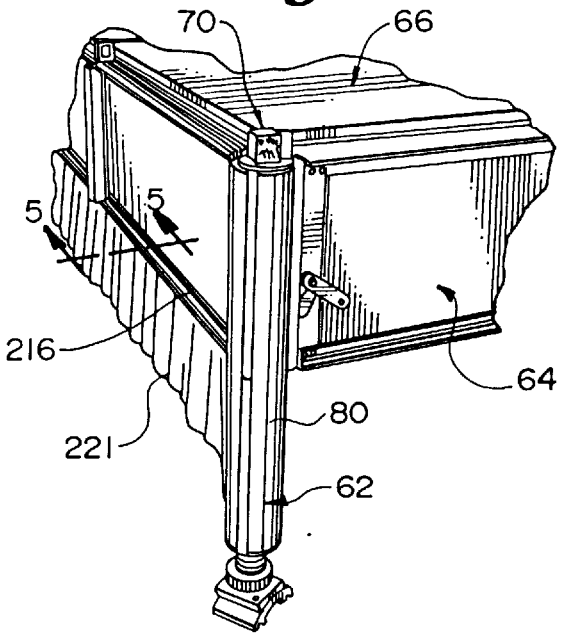
FIG. 4 is a fragmentary, perspective view of a corner of the assembled modular stage and floor system.

The floor panel engagement portion 198 of the upper and lower longitudinal peripheral members 178, 180, as best shown in FIG. 15, is irregular in cross section to present an outwardly extending surface 210 having a pair of parallel surface grooves 212 therein. An opposed pair of margin strips 216 present a pair of side grooves 220 facing the opposite direction of the surface grooves 212. Referring to FIGS. 4 and 5, a drape or bunting material 221 can be hung from a margin strip 216, 218 with a hook attachment 223. The rear surface of the floor panel engaging portion 198 (FIG. 15) of the upper longitudinal peripheral members 178, 180 includes a horizontal support panel receiving groove 224.

Figure 47:
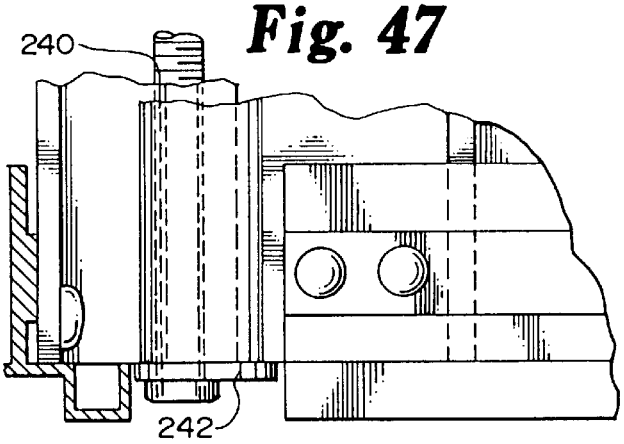
FIG. 47 is a fragmentary, side elevational view of the first and second horizontal supports depicted in FIG. 46.

Referring to FIG. 58, the intermediate connectors 182 of horizontal support 64 are fixedly carried along the horizontal support by bolts or rivets 226 received through the attachment portions 200 of upper and lower longitudinal peripheral members 178, 180. Referring in particular to FIG. 16, the intermediate connector 182 is an integral piece having opposed attachment flanges 228, outwardly extending sidewalls 232 supporting a male fitting 86 of a universal connector 68. Rod receiving channels 236 are presented by inwardly facing walls 232. Referring to FIG. 47, attachment rods 240 are received through the channels 236 (FIG. 15) to maintain a bottom support plate 242 in position at the lowermost end of side fitting 176 (FIG. 17) for supporting engagement of a female receptor 196 (FIG. 17).

Figure 13:
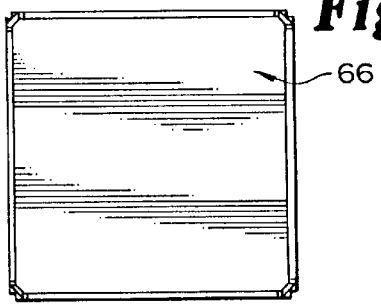
FIG. 13 is a top plan view of a modular floor panel in accordance with the present invention, it being understood that the bottom plan view is identical to the view depicted in FIG. 13.
Figure 14:
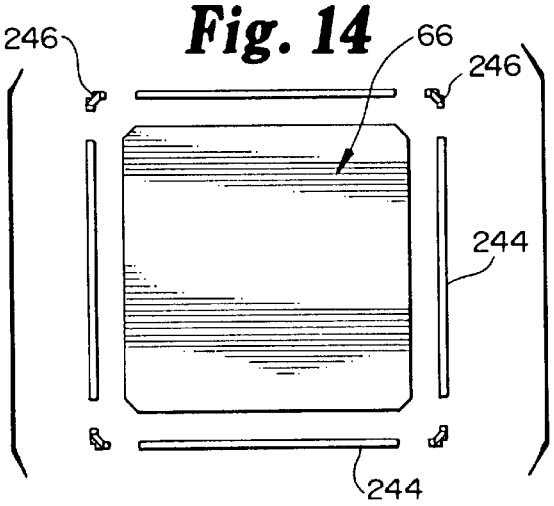
FIG. 14 is an exploded, top plan view of a modular floor panel in accordance with the present invention.

Referring to FIGS. 13 and 14, each floor panel 66 comprises reversible, square panels of decking material. The upper and lower surfaces of the panel can be of the same material, or alternatively, can comprise different materials, such as carpet on one side and a hard surface on the other. Cladding strips 244 are received along each of the four peripheral margins of the floor panel 66, and corner braces 246 are permanently received at each of the four corners of the floor panel 66.

Figure 22:
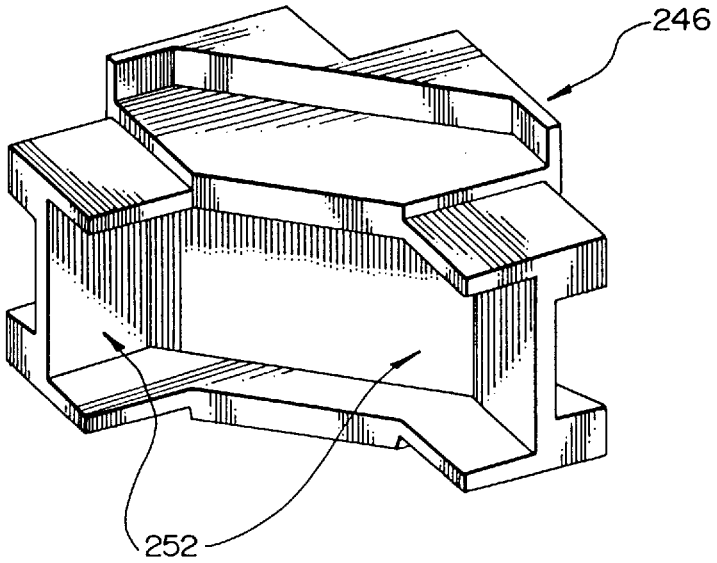
FIG. 22 is a rear elevational view of the corner brace depicted in FIG. 21.
Figure 21:
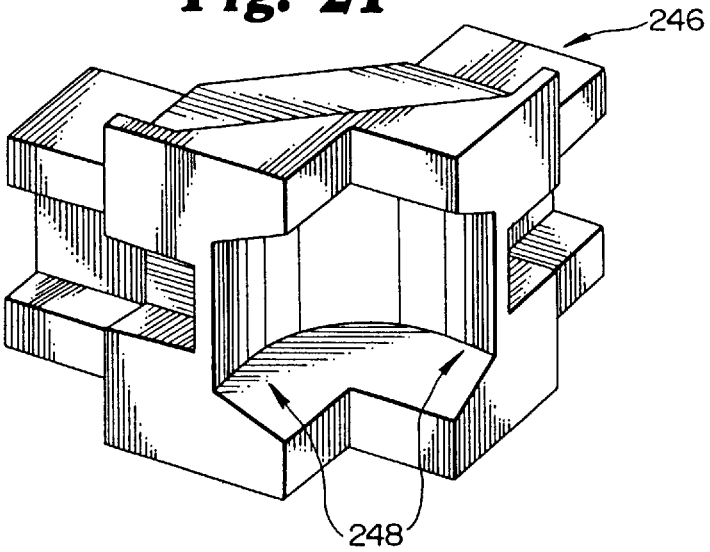
FIG. 21 is a front perspective view of a modular floor panel corner brace.

Referring to FIG. 21, the outwardly directed face of each corner brace 246 presents a pair of adjacent, orthogonally oriented latch receiving cavities 248. Referring to FIG. 22, the rear face of each corner brace 246 presents a pair of orthogonally oriented attachment channels 252 for permanently positioning the corner brace 246 within the floor panel 66.

Figure 43:
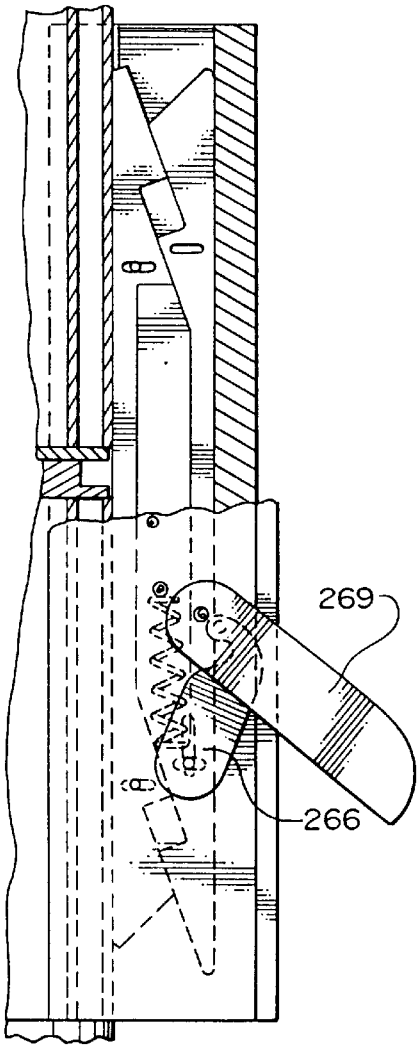
FIG. 43 is a fragmentary, elevational view of a vertical support extension coupler coupling a lower and upper vertical support, with parts cut away for clarity, and including a shim mechanism similar to that depicted in FIGS. 42*a* and 42*b*.

Referring to FIGS. 42*a*, 42*b*, 43 and 44, the horizontal supports 64 are provided with a shim mechanism 260 (FIG. 42*a*) to ensure a tight engagement of the female receptor 196 carried by the horizontal support 64 with a male fitting 86. The shim mechanism 260 includes an outer shim member 262 and inner shim member 264, biasing spring 266, and actuating assembly 268. Referring to the plan view of FIG. 44, for instance, it will be seen that each shim member 260 comprises a set of four shim elements 270 to present a member width that is four times the width of a single element 270. The outer shim member 262 is held in place within side fitting 176 by pins 272, 274 (FIG. 42*a*) received through horizontally oriented elongated grooves, 276, 278 that allow for side to side movement of the outer shim member 262. Inner shim member 264 can be shifted from the raised position, as depicted in 42*a*, to a lowered position that is depicted in 42*b* through the operation of actuating assembly 268. Biasing spring 266 extends between the inner and outer shim members 262, 264 to bias the inner shim member to the position depicted in FIG. 42*b*. FIG. 43 is presented to show a shim mechanism 266 carried by a vertical support extension coupler 280 described in more detail hereinafter. It will be appreciated from comparing the relative positions of shim members 262, 264 in FIGS. 42*a* and 42*b*, that the downward shifting of inner shim member 264, effected by the downward rotation of actuating lever 269 of actuating assembly 268, causes the complementary sloped edges 271 of the shim members 262, 264 to engage. Engagement of the sloped edges 271 causes the outer shim member 262 to shift outwardly into abutting engagement with the surface 128 of male fitting 86, tightly engaging the female receptor 196 of the horizontal support 64 with the engaged male fitting 86.

The universal connector 68 is comprised of the above-described male fittings 86 and female receptors 196. As will be apparent from a review of the drawings, together with the descriptions of the vertical and horizontal supports 62, 64 above, the universal connectors 68 allow for detachable coupling of each vertical support 62 to one or more of the horizontal supports 64 or for detachable coupling of a first horizontal support 64 to a second horizontal support 64 carrying a connector 182, all in a slidably interlocking manner. It will be further appreciated that the shim mechanism 260 carried by the side fittings 176 of the horizontal support 64 provides for a tight engagement of the female receptor 196 presented by the side fittings 176 of the horizontal supports 64 with respective male fittings 86.

Referring in particular to FIGS. 7, 8, 11 and 12, the floor locking mechanism 70 (FIG. 8) includes housing 282, side by side latch assemblies 286, and latch release mechanism 288. The floor locking mechanism housing 282 is an integral piece having a generally square in cross section base frame 290, a pair of downwardly extending attachment ribs 292, and a plurality of inwardly extending support ribs that define lowermost latch receiving guides 294, and latch release mechanism guides 298.

The latch assemblies 284, 286 each include a pair of opposed latch tabs 302 biased apart from each other by a biasing spring 306. Each tab 302 includes an upwardly extending boss 308. The latch tabs 302 are received within a respective latch receiving guide 294.

Latch release mechanism 288 includes upper and lower, mutually cooperating release brackets 310, 312 and a release bracket engaging, rotatable lever 314. The lever 314 includes an uppermost, slotted head 316 that protrudes through an uppermost aperture 318 in the base frame 290 of housing 282. It will be appreciated that rotation of the slotted head with, for instance, a screw driver, will cause the lever 314 to engage the release brackets 310, 312, spreading the upper portions of the brackets apart, and bringing the lower portions of the brackets together. The lower portions of the brackets engage the bosses 308 of the latch tabs 302. The latch tabs 302 are accordingly retracted.

It will be appreciated that the floor latching mechanisms 70 allow for positive securing of floor panels 66 on to the frame work presented by the vertical and horizontal supports 62, 64 (FIG. 7). The mechanisms 70 are positioned to receive the corner braces 246 of the floor panels. The floor panels are gently positioned on the framework, and the corner braces 246 engage the inclined upper face of respective latch tabs 302. The tabs 302 are thereby positioned inwardly, and then snap back into place under pressure from springs 306, to be inserted into a respective latch receiving cavity 248 (FIG. 21). The floor panels 66 can be removed by twisting the slotted head 316 of the release mechanism 288 to retract the latch tabs 302 from the cavity 248.

Figure 12:
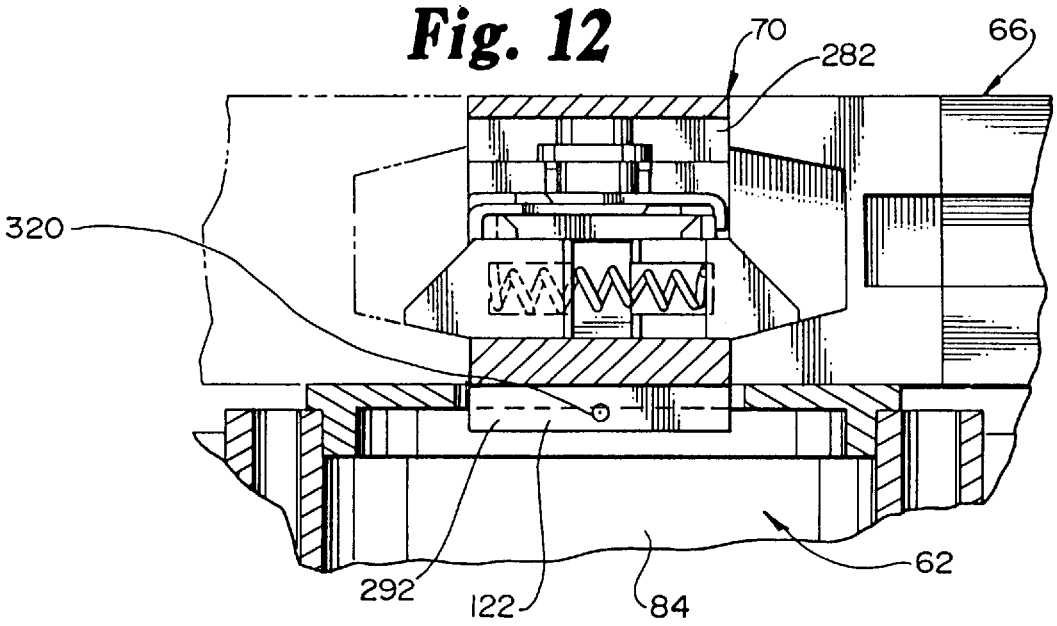
FIG. 12 is a fragmentary, sectional view taken along line 12—12 of FIG. 7.

Referring for instance, to FIG. 12, it will be seen that the attachment ribs 292 extending downwardly from the housing 282 of floor locking mechanism 70 are received through the slots 122 of vertical support top plate 84, and are maintained therein by a pin 320 or other suitable fastener. Alternatively, the attachment ribs 292 can be received within the parallel surface grooves 212, 214 in the floor panel engagement portion 198 of the horizontal support longitudinal peripheral members 178, and are held in position therein by a set screw or other suitable fastener.

The adjustable stairway assembly 72 is depicted in FIGS. 30–34. The stairway 72 includes a pair of side by side stair support assemblies 322, each extending between a respective foot member 324 and upper support plate 326. Individual step members 328 extend between the side support assemblies 322. Lower upright support posts 330 are carried by the foot members, and upper upright support posts 332 are carried by the upper supports 326. Parallel side rails 334 extend between each lower and upper support posts 330, 332.

Figure 30:
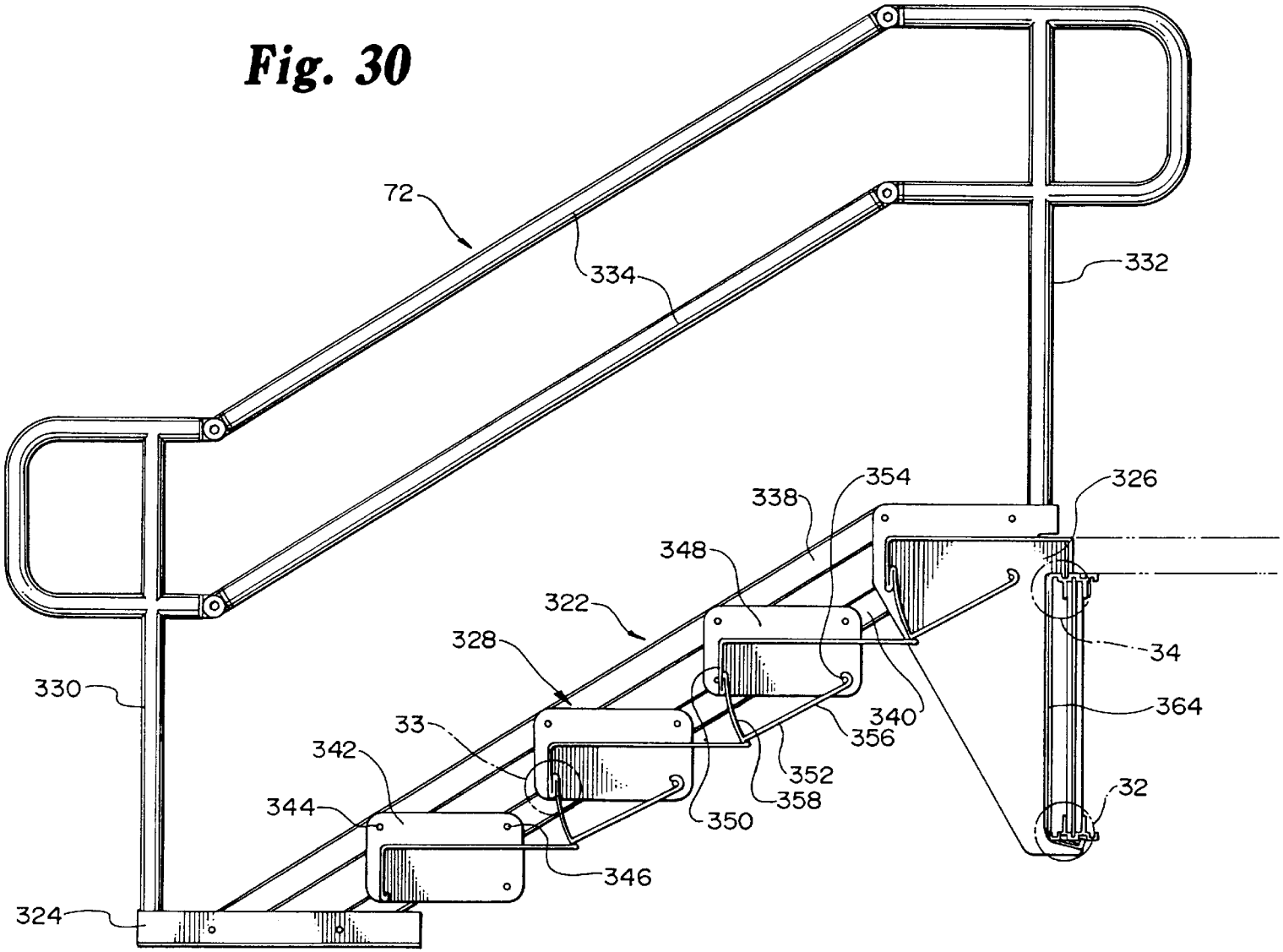
FIG. 30 is a side, elevational view of an adjustable stairway operably supported by a horizontal support of the modular stage system in accordance with the present invention.
Figure 31:
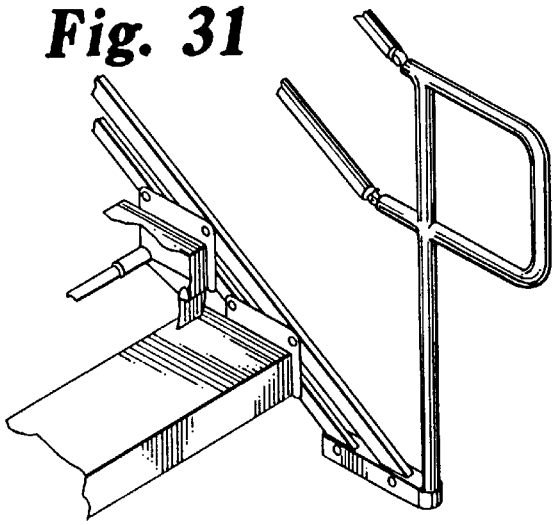
FIG. 31 is a fragmentary, perspective view of the ground engaging portion of the stairway depicted in FIG. 30.
Figure 32:
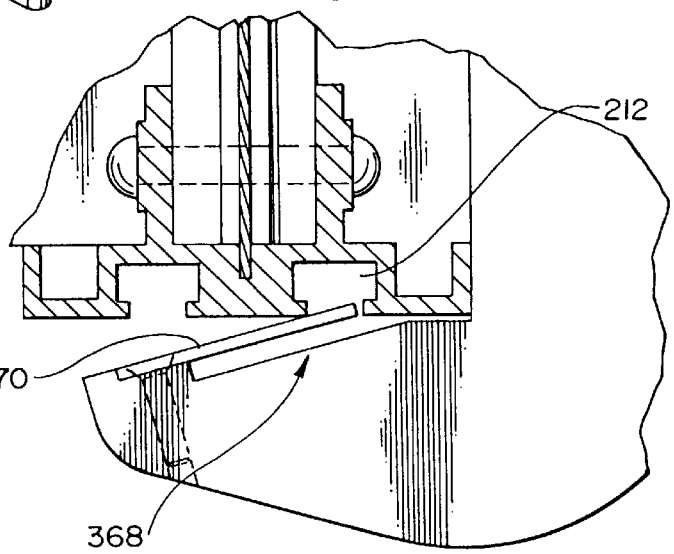
FIG. 32 is an enlarged, fragmentary view taken at 32 of FIG. 30.

Side assemblies 322 each include an upper and lower beam 338, 340 of a four bar mechanism. Each step member 328 includes opposed side supporting plates 342. Each side support plate 342 is pivotally coupled to its respective upper beam 338 at a leading pivot point 344, and is pivotally coupled to its respective lower beam 340 by a trailing pivot point 346. As is best seen in FIG. 30, the upper and lower beams 338, 340 are pivotally coupled at respective pivot points to the stairway foot member 324 and upper support 326.

Figure 33:
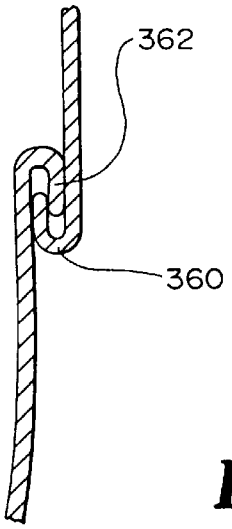
FIG. 33 is an enlarged, fragmentary view taken at 33 of FIG. 30.

Each step member 328 includes a generally horizontal step surface 348, and downwardly extending front panel 350. A panel extension member 352 is pivotally carried by each step member. Each extension member 352 includes a support panel 354 pivotally carried by support rod 356 extending between the steps member side support plates 342 and a gently curved front panel 358. Referring in particular to FIG. 33, it will be seen that the front panel 358 extending downwardly from step surface 348 includes a upwardly curved rim 360. The curved front panel 358 of the panel extension member 352 includes a downwardly curved lift 362 that is engageable with the upwardly curved lift 360. The panel extension members 352 rest on the step surface 348 below it, and is pivoted about support rod 356 by the engagement with the step surface as the stair assembly is raised and lowered.

Figure 34:
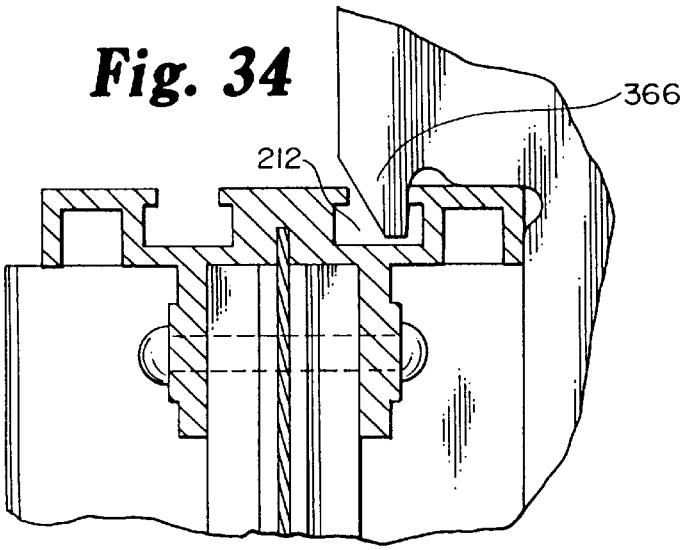
FIG. 34 is an enlarged, fragmentary view taken at 34 of FIG. 30.
Figure 37:
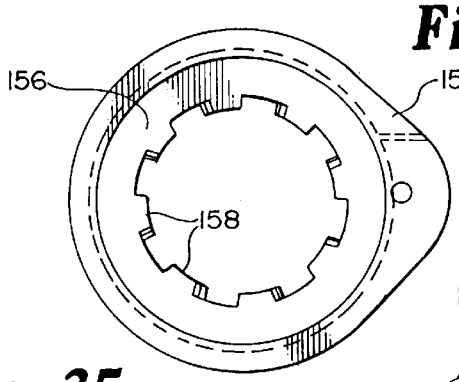
FIG. 37 is a top plan view of the telescoping vertical support depicted in FIG. 35.

Side support plates 342 are generally triangular panels that include a generally upright engagement margin 364. Each engagement margin 364 presents a uppermost attachment hook 366, depicted in detail in FIG. 34, and a lowermost engagement assembly 368, depicted in detail in FIG. 32. Referring to FIG. 34, the upper engagement hook 366 is received within the surface groove 212 of the floor engagement portion 198 of a respective horizontal support longitudinal peripheral member 178. The lower engagement assembly 368 (FIG. 32) includes a leaf spring 370 that is engageable with the downwardly facing surface groove 212 of the lower longitudinal peripheral member 180 of the respective horizontal support 64.

Figure 28:
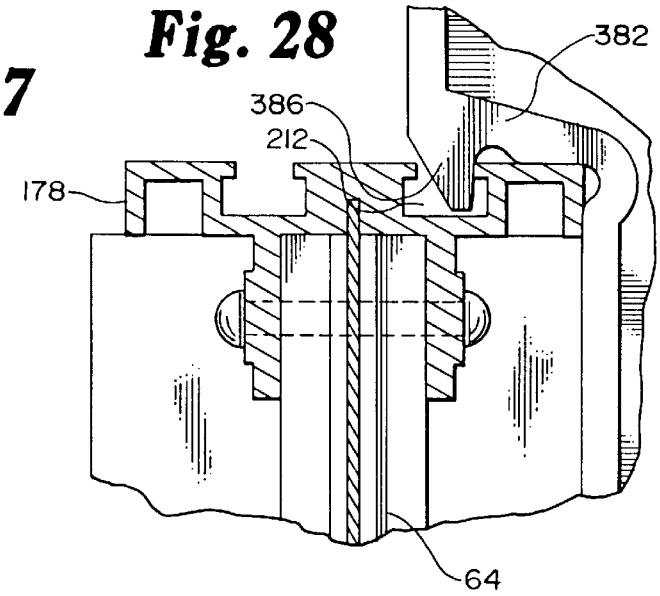
FIG. 28 is an enlarged, fragmentary view taken at 28 of FIG. 27.
Figure 29:
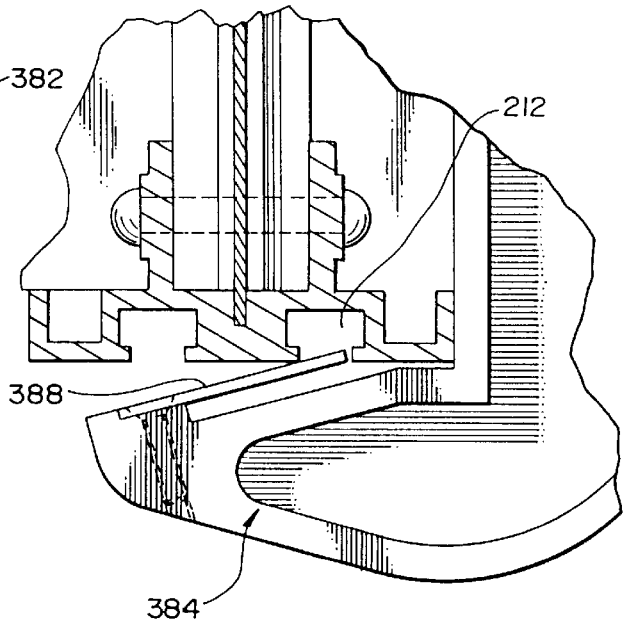
FIG. 29 is an enlarged, fragmentary view taken at 29 of FIG. 27.

The attachable guardrails 78 are depicted in FIGS. 26–29. The guardrails 78 are integral pieces having an uppermost extension portion 372 (FIG. 26) and a lowermost attachment portion 374. The extension portion 372 includes rail receiving apertures 376, 378 that receive rails 379 (as shown in FIG. 1). The lowermost attachment portion includes a generally upright engagement margin 380 for detachable coupling with a horizontal support 64. The engagement margin 380 includes an upper engagement assembly 382, as depicted in FIG. 28, and a lower engagement assembly 384, as depicted in FIG. 29. The upper engagement assembly 382 (FIG. 28) includes a hook member 386 that is receivable within the surface groove 212 in the upper longitudinal peripheral member 178 of respective horizontal support 64. The lower engagement assembly (FIG. 29) includes a leaf spring 388 engageable with the surface groove 212 of the lower longitudinal peripheral member 180 of horizontal support 64.

Figure 24:
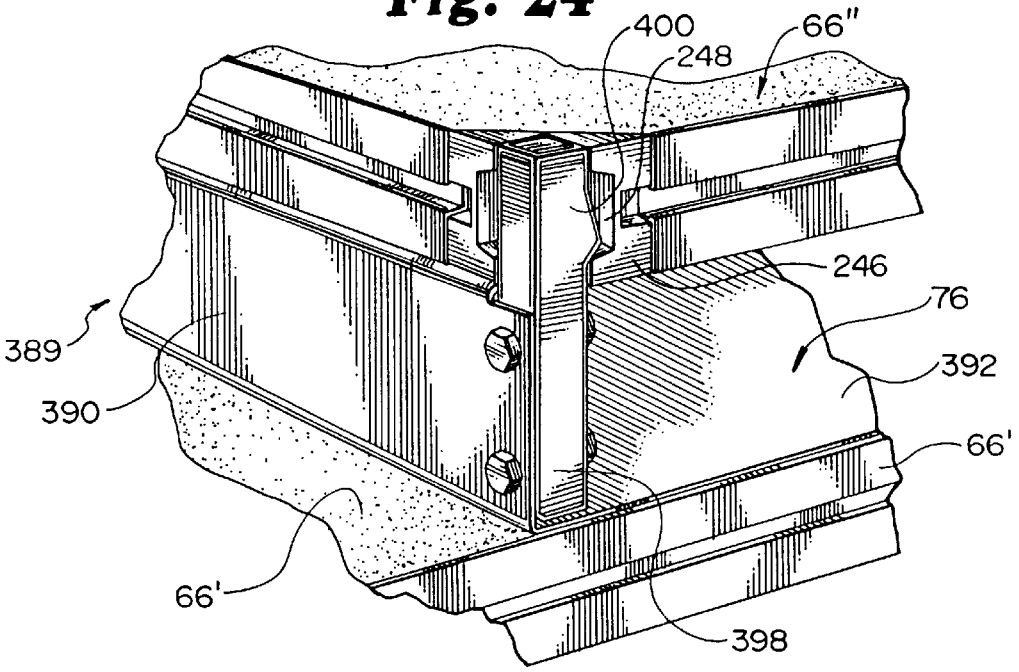
FIG. 24 is fragmentary, perspective view depicting the leading edge of the upper modular floor panel depicted in FIG. 23 in relation to the lower floor panel.
Figure 25:
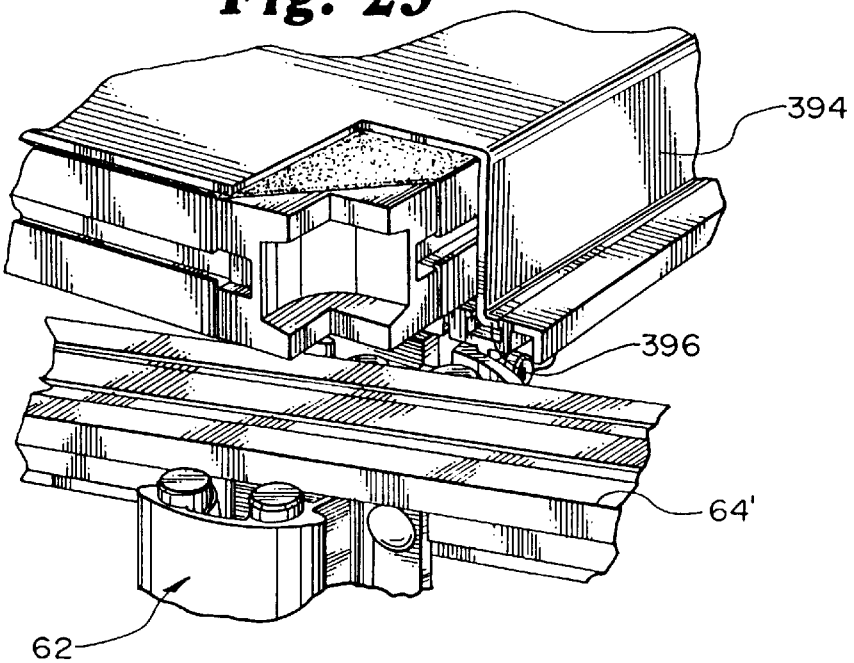
FIG. 25 is a fragmentary, perspective view depicting the rear edge of the lower floor panel of FIG. 23.
Figure 26:
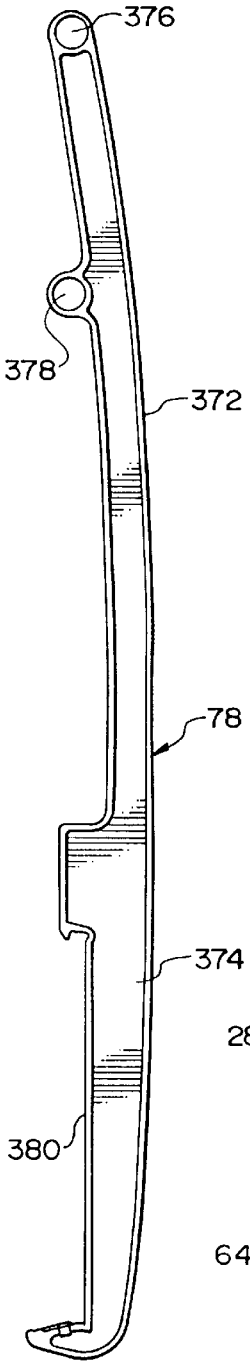
FIG. 26 is an elevational view of a side rail for the modular stage in accordance with the present invention.
Figure 27:
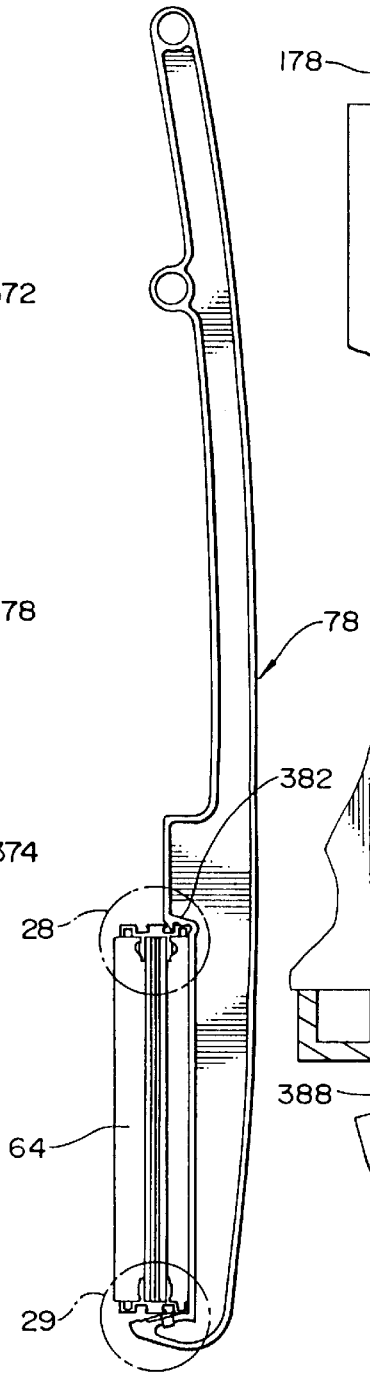
FIG. 27 is an elevational view depicting the side rail of FIG. 26 matingly coupled to a horizontal support.

A floor step adaptor 76 is depicted in FIGS. 23–25. The step adaptor comprises an angled panel 389 having a upright front wall 390 (FIG. 24), a horizontal base panel 392, and a downwardly extending rear wall 394 (FIG. 25). The base panel 392 rests on a lower floor panel 66', as indicated in FIGS. 23–25, and the rear wall 394 includes an engagement flange 396 that is received within the surface groove 212 of the upper longitudinal peripheral member 178 of a respective horizontal support 64. An upper floor panel 66" is carried by upright post 398 that is bolted to the front panel 390. The upright post 398 includes an uppermost engagement boss 400 that is receivable within the latch receiving cavity 248 of a floor panel corner brace 246 (also see FIG. 21). Referring to FIGS. 1 and 25, it will be appreciated that a modified horizontal support 64' with a slight inclination is provided to accommodate the floor step adaptor.

Figure 50:
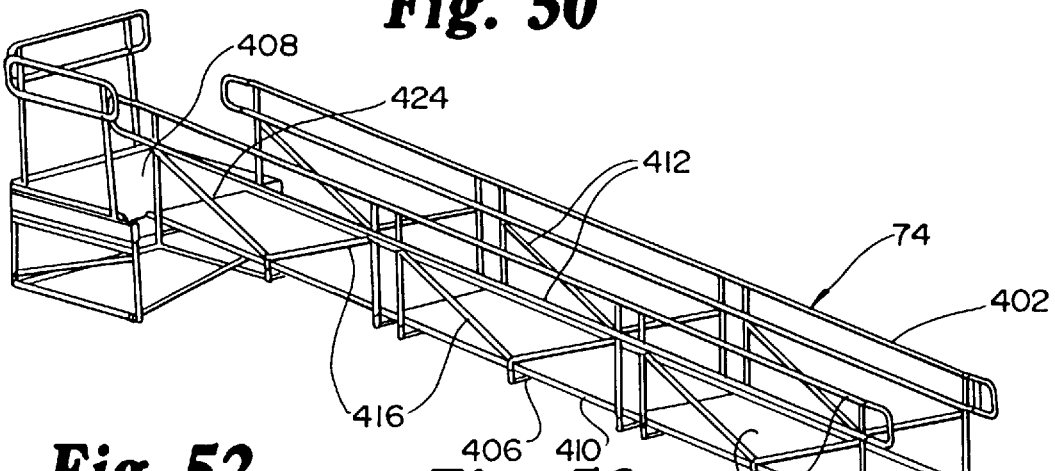
FIG. 50 is a perspective view of an access ramp.

Access ramp 74 is depicted in FIGS. 50–57. The ramp 74 can comprise a single segment, or as depicted in FIG. 50, a plurality of interlocked segments. The access ramp includes a ramp panel 400 extending the length of each ramp segment, and right and left side rail assemblies 402, 404. Lowermost support channels 406 extend between the side rail assemblies 402, 404. The access ramp 74 is depicted in FIG. 50 as being supported at its uppermost end by landing 408.

Side rail assemblies 402, 404 can comprise a single segment, or as depicted in FIG. 50, a plurality of segments attached together. Each side assembly segment includes a lowermost inclined base channel 410, a pair of uppermost, parallel hand rails 412 and a plurality of truss rails 416 extending between the base channel 406 and hand rails 412. It will be appreciated, with reference to FIG. 50, that there are no lowermost support posts or feet supporting the ramp 74, and that the downward load carried by the ramp 74 is fully supported by the lattice work of truss rails 416, base channels 410, and hand rails 412.

Figure 52:
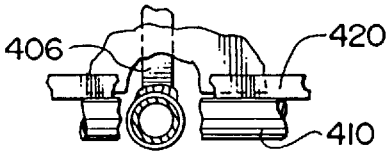
FIG. 52 is a fragmentary, sectional view taken at 52 of FIG. 51.
Figure 53:
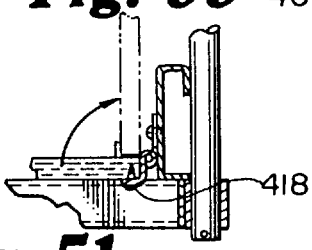
FIG. 53 is a fragmentary, sectional view taken along the line 53—53 of FIG. 51.
Figure 51:
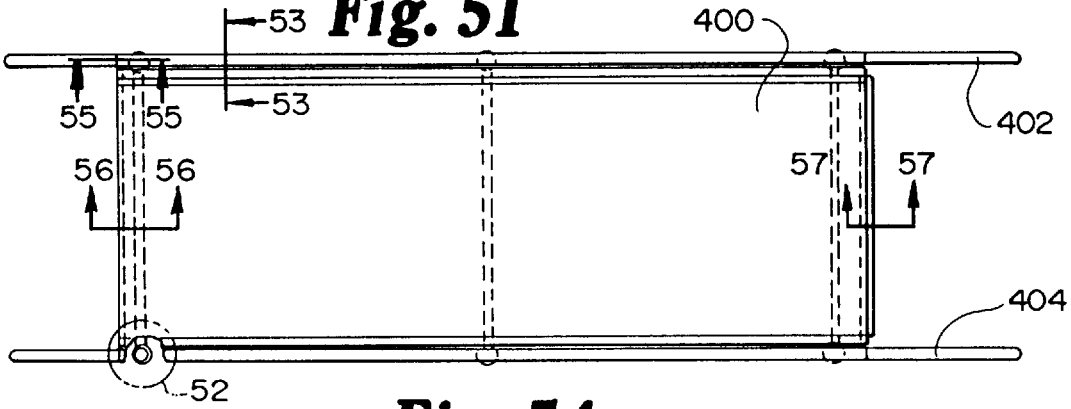
FIG. 51 is a top plan view of the access ramp depicted in FIG. 50.
Figure 54:
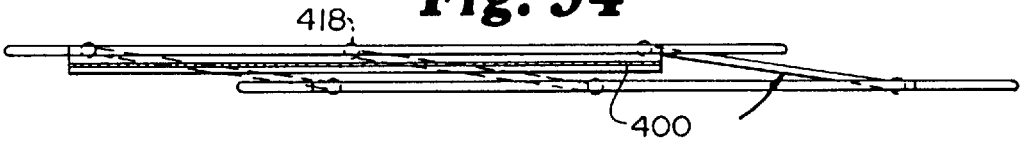
FIG. 54 is a top plan view of the access ramp depicted in FIG. 51 in a folded, collapsed position.

Referring to FIG. 52, the support channels 406 of ramp 74 are pivotally coupled to the base channels 410 of the side support assemblies 402, 404. With reference to FIG. 53, it will be seen that the ramp panel 400 is pivotally carried by hinge 418 extending along one of the two guide rail assembly base channels 410. With reference again to FIG. 52, it will be seen that the opposite margin of the ramp panel is carried by a support curb 420. With reference to FIG. 54, it will be appreciated that the ramp panel 400 can be pivoted upwardly along hinge 418, and the side rail assemblies 402, 404 can be collapsed together by the pivoting of the support channels 406 with respect to the side rail assembly base channels 410.

Figure 55:
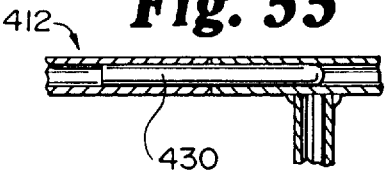
FIG. 55 is a fragmentary, sectional view taken along the line 55—55 of FIG. 51.
Figure 56:
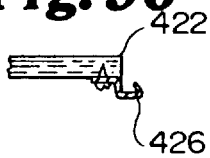
FIG. 56 is a fragmentary, sectional view taken along the line 56—56 of FIG. 51.
Figure 57:
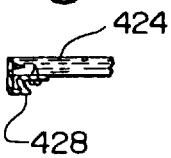
FIG. 57 is a fragmentary, sectional view taken along the line 57'57 of FIG. 51.

Each ramp panel segment includes an entrance end 422 (FIG. 50) and an exit end 424, an entrance margin 422 and an exit margin 424. An entrance end connection channel 426 is carried along the entrance margin, as depicted in FIG. 56, and an exit end connection channel 428 is carried along the exit margin 424 (FIG. 57). The exit and entrance channels 426, 428 can be fit together in an interlocking fit. Connector pins 430 can be received within the tubular inner surfaces of hand rails 412 to effect a positive connection between the hand rail segments (FIG. 55).

Figure 48:
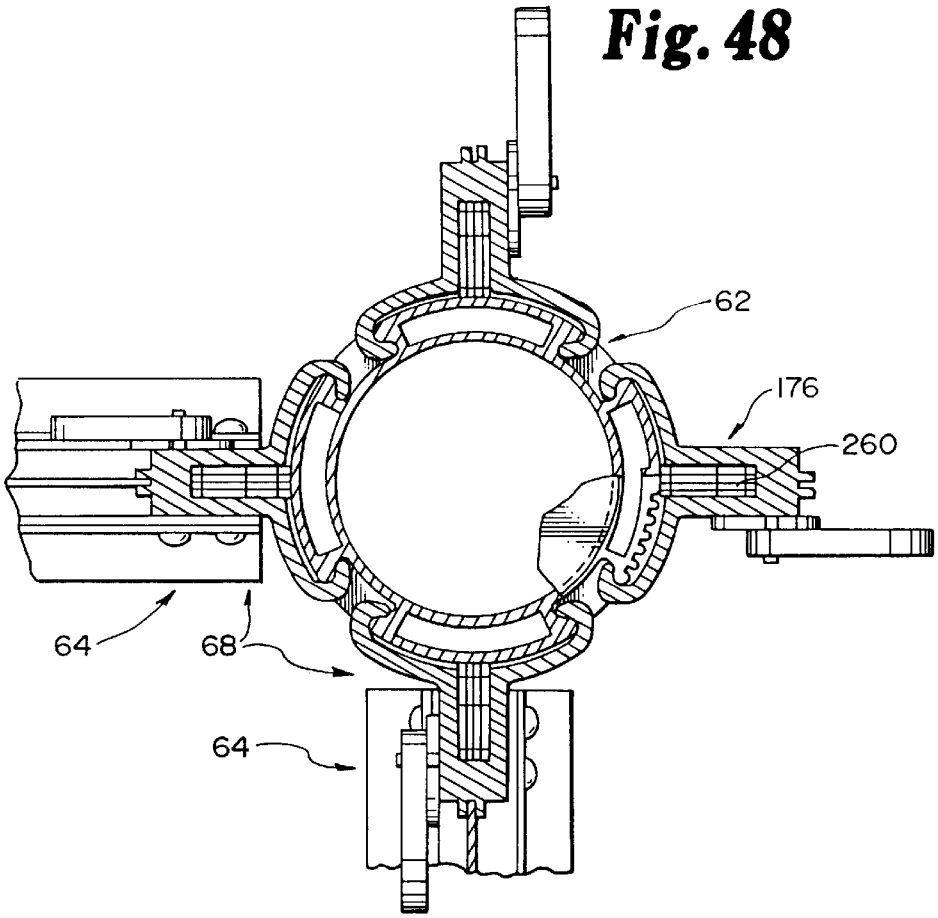
FIG. 48 is similar to FIG. 44, but additionally depicting a pair of vertical support extension couplers carried by the vertical support.
Figure 49:
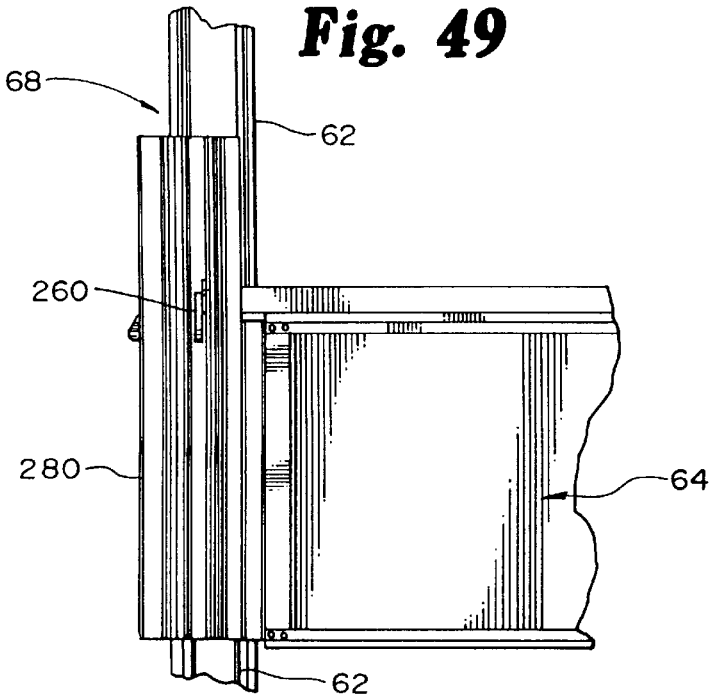
FIG. 49 is an elevational, fragmentary view depicting an upper vertical support coupled to a lower vertical support via a vertical support extension member.

FIGS. 48 and 49 depict the vertical support extension coupler 280. The coupler 280 has the same construction as the horizontal support side fittings 176, including a shim mechanism 260, and similar components are annotated with like numbers. Referring to FIG. 49, however, it will be seen that the extension coupler extends beyond the top of the vertical support 62, such that a second vertical support 62 can be carried by the upper portion of the coupler 280.

It will be apparent from the attached drawings and above description that either a permanent or temporary stage or platform can be easily planned and assembled with the modular system in accordance with the present invention. The desired floor plan can be created by selecting the needed vertical supports 62, coupling the vertical supports together with horizontal supports 64, and securely placing floor panels 66 on the resulting framework with floor locking mechanisms 70. Ready access to the floor surface can be provided at any point along the periphery of the surface by attachment of an adjustable stairway 72 or access ramp 74 to a horizontal support 64. Varying platform levels can be provided through the use of telescoping vertical supports 62' vertical support extension couplers 280, and floor step adapters 76.

Figure 59:
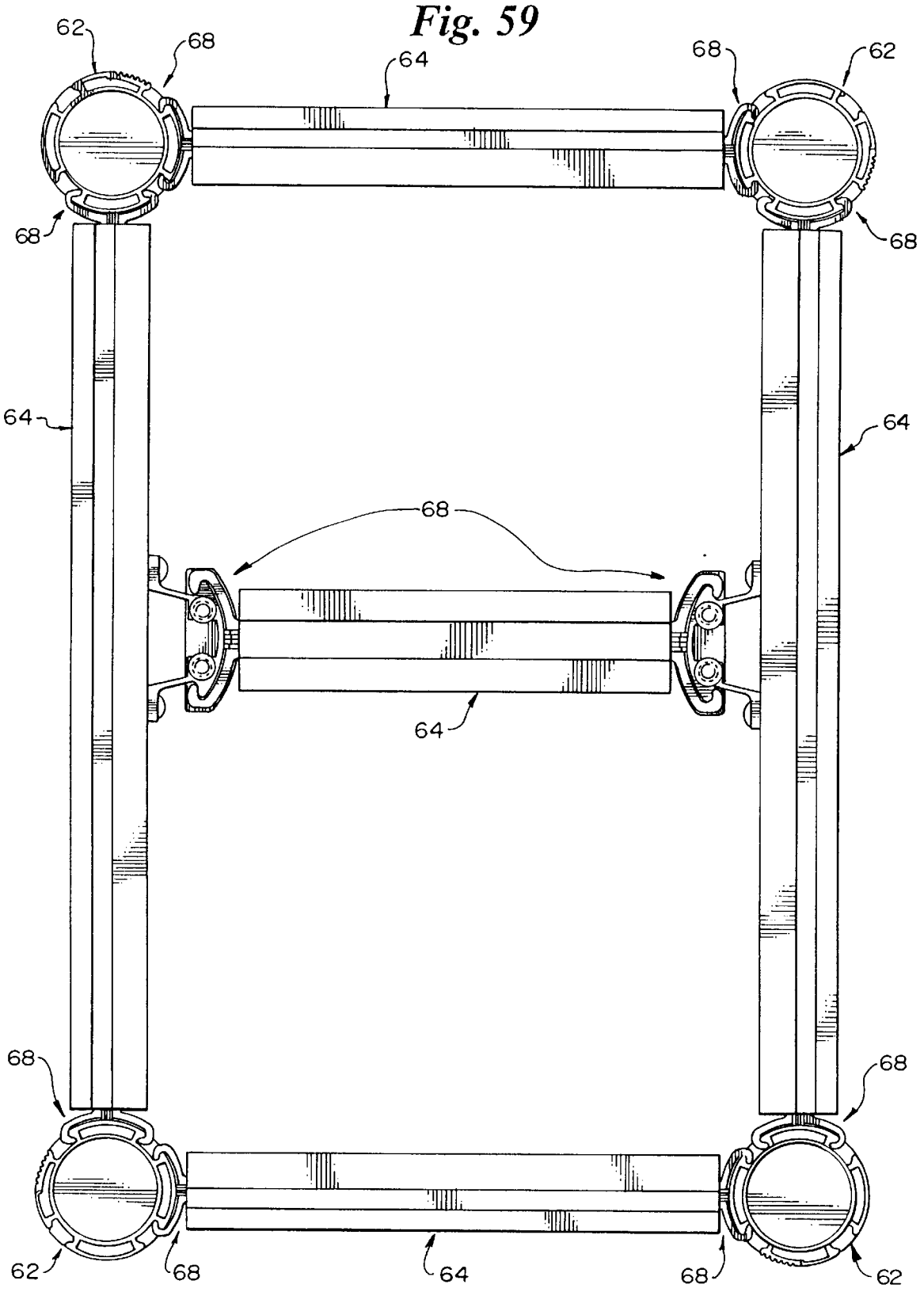
FIG. 59 is a top plan view of another embodiment of the present invention with a fifth horizontal support 64 thereby providing a cross truss.

The use of the unique universal connectors 68, vertical and horizontal supports 62, 64, and modular deck or floor panels 66 enables the construction of a modular portable stage or floor with at least four vertical supports 62, four horizontal supports 64 and eight universal connectors 68. The four vertical supports 62 provide for four corners, and the four horizontal supports 64 extend between the corners. The eight universal connectors 68 provide for positive, slidable interlocking connections between the vertical and horizontal supports. In practical arrangements, and as shown in FIG. 59, a fifth horizontal support 64 with an additional pair of universal connectors 68 would provide a cross truss between a parallel pair of horizontal supports 64.

Although the description of the preferred embodiment has been presented, it is contemplated that various changes could be made without deviating from the spirit of the present invention. Accordingly, it is intended that the scope of the present invention be dictated by the appended claims, rather than by the description of the preferred embodiment.

What is claimed is:

1. A modular portable stage system comprising:

a plurality of modular deck panels;

at least four modular vertical supports;

at least five modular horizontal members, at least four of the horizontal members connecting between at least two of the vertical supports and at least one of the horizontal members connecting only between two other horizontal members; and at least ten universal connector means, each of at least eight of the universal connector means for detachably coupling one of the vertical supports to one of the horizontal members in a slidably interlocking manner and each of at least two of the universal connector means for detachably coupling two of the horizontal members together in a slidably interlocking manner, such that a frame support structure for the portion of the modular portable stage system is assembled by slidably interlocking together the vertical supports and the horizontal members using the universal connector means so that each deck panel will be supported on the 4 frame support structure by at least two horizontal members.

2. A method for assembling a modular portable stage system comprising the steps of:

(a) selectively positioning at least four modular vertical support members according to a selectively predetermined floor plan for the portable stage system;

(b) selectively positioning at least five modular horizontal support members according to the selectively predetermined floor plan, at least four of the horizontal support members being positioned between at least two of the vertical support members and least one of the horizontal support members being positioned only between two other horizontal support members;

(c) utilizing at least ten universal connector mechanisms to connect the vertical support members and horizontal support members together as a frame support structure for the portable stage system without the use of any tools, at least eight of the universal connector mechanisms being utilized for detachably coupling one of the vertical support members to one of the horizontal support members in a slidably interlocking manner and at least two of the universal connector mechanisms being utilized for detachably coupling two of the horizontal support members in a slidably interlocking manner, and (d) supporting a plurality of modular deck panels on the frame support structure, such that the frame support structure is assembled by slidably interlocking together the vertical support members and the horizontal support members using the universal connector mechanisms so that each deck panel will be supported on the frame support structure by at least two horizontal support members.

3. A modular portable stage system comprising:

a plurality of modular deck panels;

at least four modular vertical supports;

at least four modular horizontal members support means, each of the horizontal members being connected between at least two of the vertical supports or between two other horizontal members such that the horizontal members provide direct vertical support to the deck panels; and at least eight universal connector means, each of the universal connector means for detachably coupling one of the vertical supports to one of the horizontal members in a slidably interlocking manner or for detachably coupling two of the horizontal members together in a slidably interlocking manner, and including:

a male fitting permanently connected to the vertical support or the horizontal member comprised of a generally vertically-oriented convex arcuate surface and a pair of opposed engagement margins supported by a support wall, all of which are integral with and extend horizontally from the vertical support or the horizontal member; and a female receptor permanently connected to the horizontal member comprised of a generally vertically-oriented concave arcuate surface corresponding in shape to the generally vertically-oriented convex arcuate surface of the male fitting and a pair of opposed engagement tabs supported by a base, all of which are integral with and extend horizontally from the horizontal member, such that the female receptor is positioned above the male fitting and slidably interlocked onto the male fitting to create the universal connector means.

4. The modular portable stage system of claim 1 wherein the horizontal member is an integral component comprising:

an upper and a lower longitudinal peripheral member;

a load bearing support panel integrally interposed between the upper and lower longitudinal peripheral members; and a pair of side fittings integrally attached, one at each end, between the upper and lower longitudinal peripheral members.

5. The modular portable stage system of claim 1 wherein the vertical support comprises:

a leg portion; and a foot portion at the lowermost end of the leg portion, the foot portion including:

a lowermost ground engaging plate having an upwardly facing arcuate surface, a slide plate operably connected to the leg portion and shiftably carried along the upwardly facing arcuate surface of the ground engaging plate, and means for selectively positioning the slide plate relative to the ground engaging plate to allow leveling of the slide plate and the leg portion relative to the ground engaging plate.

6. The modular portable stage system of claim 1 wherein the vertical support comprises:

a leg portion having a lower plate; and an infinite adjustment mechanism at the lowermost end of the leg portion, the infinite adjustment mechanism including:

a threaded post threadably received within the lower plate of the leg portion and extendable and retractable relative to the leg portion when rotated, and gear means operably connected to the threaded post for rotating the threaded post relative to the leg portion.

7. The modular portable stage system of claim 1 wherein the vertical support comprises:

a generally tubular leg portion having a plurality of generally longitudinal ribs defined around either the inner or outer longitudinal surface of the tubular leg, the ribs defining a plurality of continuous, longitudinal channels therebetween and each rib having a lower mating surface at the lowermost end of the tubular leg portion;

an extension leg means for slidably mating with the tubular leg portion in a concentric manner and having a plurality of longitudinal rib portions defined around the opposite of the longitudinal surfaces on which the ribs are defined on the tubular leg portion for slidably engaging one or more corresponding longitudinal channels in the tubular leg portion, each rib portion having a plurality of generally vertical ribs defining a plurality of non-continuous rib sections having an upper mating surface and being separated from adjacent longitudinal rib portions by one or more longitudinally spaced apart circumferential grooves; and collar means for selectively rotating about the tubular leg portion and the extension leg portion, such that the extension leg portion can be slid upward or downward along the longitudinal channels until the lowermost end of the tubular leg portion is positioned at one of the circumferential grooves whereat the collar means can selectively rotate about the tubular leg portion so that the lower mating surface of the ribs of the tubular leg portion are supported by the upper mating surfaces of the rib sections of one of the rib portions of the extension leg portion.

8. The modular portable stage system of claim 1 further comprising an adjustable stairway that has an upper end that can be selectively vertically supported at a desired height and includes a plurality of steps such that the distance between a floor and the lowermost step and between each subsequent adjacent pair of steps will have equal rise/run dimensions regardless of the desired height at which the upper end is selectively positioned.

9. The modular portable stage system of claim 1 further comprising an adjustable ramp having one or more interlocking ramp segments that form the adjustable ramp such that there are no lowermost support posts or feet supporting the adjustable ramp between the frame support and an end of the adjustable ramp.

10. The modular portable stage system of claim 3 wherein each vertical support is a generally tubular member and is provided with at least four male fittings oriented about the tubular member at equally spaced intervals, and wherein the at least four male fittings define at least four respective, generally angular and equally spaced slots located around the periphery of the tubular member between adjacent male fittings.

11. The modular portable stage system of claim 10 wherein each vertical support further comprises at least one spacer bar adapted for insertion into the slots to provide an engagement surface for supporting the tabs of the female receptor at a desired height.

12. The modular portable stage system of claim 3 wherein at least one of the universal connector means further comprises:

a shim means operably connected to the horizontal members for ensuring a tight engagement of the female receptor to the male fitting such that cross brace supports are not required for the frame support structure.

13. The modular portable stage system of claim 12 wherein the shim means is oriented such that the shim means tends to tighten and not loosen with any movement of the portable stage system.

14. The modular portable stage system of claim 12 wherein the shim means includes:

an outer shim member, an inner shim member, a biasing means for biasing the outer shim member against the inner shim member, and actuating means for actuating and releasing the biasing means, such that a surface on the outer shim member is biased into abuttable engagement with a corresponding surface on the male fitting when the biasing means is actuated by the actuating means.

15. The modular portable stage system of claim 1 wherein at least two of the horizontal members are capable of spanning the length of multiple ones of the modular deck panels without requiring a vertical support at each corner of every modular deck panel.

16. The modular portable stage system of claim 1 wherein the plurality of modular deck panels are all of a uniform size and shape.

17. The modular portable stage system of claim 16 wherein the horizontal members are provided in a series of standard lengths, each of the standard lengths comprising an integer multiple of the length of one of the modular deck panels, and wherein each horizontal member that is longer than the length of one of the modular deck panels further includes a male fitting of the universal connector permanently connected along the length of the horizontal members.

18. The modular portable stage system of claim 16 wherein each deck panel is comprised of a reversible square of decking material having a predetermined, uniform thickness, a cladding strip permanently affixed along each of the four peripheral edges, and four corner braces permanently received at each of the four corners of the deck panel.

19. The modular portable stage system of claim 18 wherein each of the four corner braces is provided with a pair of adjacent, orthogonally oriented latch receiving cavities on each outwardly directed face of each corner brace, the latch receiving cavities adapted to cooperate with a deck panel locking means for securing the deck panel to the frame support structure.

20. The modular portable stage system of claim 1 further comprising:

at least one vertical support extension coupler means for vertically connecting together two vertical supports using at least one of the universal connector means.

21. The modular portable stage system of claim 20 wherein each vertical support extension coupler means comprises:

a vertical base;

a pair of arms extending outwardly from the vertical base and defining a pair of female receptors for two of the universal connector means; and engagement means operably connected to the vertical base for ensuring a tight engagement of one of the female receptors to a male fitting on one of the two vertical supports.

22. The modular portable stage system of claim 21 wherein the engagement means comprises:

a shim means operably connected to the vertical base for ensuring a tight engagement of one of the female receptors to a male fitting on one of the two vertical supports, the shim means including:

an outer shim member;

an inner shim member;

a biasing means for biasing the outer shim member against the inner shim member, and actuating means for actuating and releasing the biasing means, such that a surface on the outer shim member is biased into abuttable engagement with a corresponding surface on the male fitting when the biasing means is actuated by the actuating means.

23. The modular portable stage system of claim 1 further comprising a plurality of detachable guardrail posts, each guardrail post being an integral piece and comprising:

an uppermost extension portion having at least one rail receiving aperture; and a lowermost attachment portion having a generally upright engagement margin for mating with a horizontal member to support the guardrail post, the engagement margin including:

an uppermost attachment hook that can be selectively received within a groove in an upper surface of the horizontal member, and a lowermost engagement assembly having biasing means for engaging a downwardly facing surface groove in a lower surface of the horizontal member.

24. The modular portable stage system of claim 1 wherein the frame support structure can be constructed to have different heights for different ones of the deck panels.

25. The modular portable stage system of claim 24 further comprising one or more floor step adapters for providing a step between adjacent deck panel of different heights, each floor step adapter comprising:

an angled panel having:

an upright front panel, and a horizontal base panel adapted to rest on a lower one of the adjacent deck panels;

a downwardly extending rear wall having an engagement flange that can be received with a surface groove of a horizontal member supporting the lower one of the adjacent deck panels; and one or more upright posts fixedly connected to the front panel for engaging and supporting an upper one of the adjacent deck panels.

26. The modular portable stage system of claim 1 further comprising:

a plurality of deck panel locking means for securing the deck panels to the frame support system.

27. A vertical support member for connecting with other like vertical support members and a plurality of horizontal support members that form a frame support structure for a stage or flooring system, the vertical support member comprising:

a generally tubular leg portion having a plurality of generally longitudinal ribs defined around either the inner or outer longitudinal surface of the tubular leg, the ribs defining a plurality of continuous, longitudinal channels therebetween and each rib having a lower mating surface at the lowermost end of the tubular leg portion;

an extension leg means for slidably mating with the tubular leg portion in a concentric manner and having a plurality of longitudinal rib portions defined around the opposite of the longitudinal surfaces on which the ribs are defined on the tubular leg portion for slidably engaging one or more corresponding longitudinal channels in the tubular leg portion, each rib portion having a plurality of generally vertical ribs defining a plurality of non-continuous rib section having an upper mating surface and being separated from adjacent longitudinal rib portions by at least one longitudinally spaced apart circumferential grooves; and collar means operably connected to the tubular leg portion for selectively rotating about the tubular leg portion and the extension leg portion, such that the extension leg portion can be slid upward or downward along the longitudinal channels until the lowermost end of the tubular leg portion is positioned at one of the circumferential grooves whereat the collar means can selectively rotating about the tubular leg portion so that the lower mating surface of the ribs of the tubular leg portion are supported by the upper mating surfaces of the rib sections of one of the rib portions of the extension leg portion.

28. The vertical support member of claim 27 further comprising:

a foot portion at the lowermost end of the leg portion, the foot portion including:

a lowermost ground engaging plate having an upwardly facing arcuate surface, a slide plate operably connected to the leg portion and shiftably carried along the upwardly facing arcuate surface of the ground engaging plate, and means for selectively positioning the slide plate relative to the ground engaging plate to allow leveling of the slide plate and the leg portion relative to the ground engaging plate.

29. The vertical support member of claims 27 further comprising:

an infinite adjustment mechanism at the lowermost end of the leg portion, the infinite adjustment mechanism including:

a threaded post threadably received within the lower plate of the leg portion and extendable and retractable relative to the leg portion when rotated, and gear means operably connected to the threaded post for rotating the threaded post relative to the leg portion.

30. The vertical support member of claim 29 wherein the gear means comprises:

a first gear fixedly connected to the threaded post;

an adjustment bit aperture defined in a foot portion at the lowermost end of the leg portion;

an adjustment bit having:

a proximal end for insertion into an electric drill or other apparatus for providing rotational motion thereto;

a distal end adapted to be received in the adjustment aperture; and a second gear fixedly connected between the proximal end and the distal end and adapted to be gear engaged with the first gear.

31. A modular horizontal support member for a frame support structure of a portable stage system that when assembled can support a plurality of modular deck panels, the horizontal support member comprising:

an upper and a lower longitudinal peripheral member;

a load bearing support panel integrally interposed between the upper and lower longitudinal peripheral members; and a pair of side fittings integrally attached, one at each end, between the upper and lower longitudinal peripheral members, each side fitting presenting an exterior surface adapted to mate with a compatible fitting on a vertical support member of the portable stage system.

32. The horizontal support member of claim 31 wherein the horizontal support member is symmetric and reversible and the upper and the lower longitudinal peripheral member comprise a unitary piece having:

a deck panel engaging portion including:

an outwardly extending surface having at least two parallel surface grooves;

an opposed pair of margin strips having at least one side groove facing the opposite direction from the surface grooves; and an inwardly extending surface having a support panel receiving groove for receiving the support panel; and an attachment portion including at least one spaced apart ribs that present a clevis groove for receiving the side fittings.

33. The horizontal support member of claim 31 wherein the horizontal support member is symmetric and reversible and each of the side fittings comprise a unitary piece having:

a vertical base;

a pair of ribs extending inwardly from the vertical base and defining a support panel receiving groove for receiving the support panel; and a pair of arms extending outwardly from the vertical base.

34. The horizontal support member of claim 31 further comprising:

at least one side fitting spaced longitudinally along the horizontal support member for detachably coupling at least two of the horizontal support members together, each side fitting comprising a unitary piece having:

a pair of opposed attachment flanges for fixedly attaching the side fitting to the upper and the lower longitudinal peripheral members;

a pair of sidewalls, each sidewall extending outwardly from a corresponding one of the attachment flanges; and a generally vertically-oriented, convex arcuate surface and a pair of opposed engagement margins, each engagement margin supported by a corresponding sidewall.

* * * * *

UNITED STATES PATENT AND TRADEMARK OFFICE

CERTIFICATE OF CORRECTION

PATENT NO. : 5,848,501

DATED : December 15, 1998

INVENTOR(S) : Taipale et al.

It is certified that error appears in the above-identified patent and that said Letters Patent is hereby corrected as shown below:

In the Abstract, line 8, after "together" insert --,--; line 9, after "mechanism" insert --,--.

Column 2, line 19, after "structures" insert --,--.

Column 7, line 41, delete "57'57" and insert --57–57-.

Column 12, line 44, delete "steps" and insert --step--.

Column 12, lines 47 and 57, delete "a" and insert --an--.

Column 13, line 19, delete "a" and insert --an---.

Column 14, line 31, delete "62'" and insert --62,--.

Column 15, line 7, delete "4".

Column 15, line 33, after manner delete "," and insert --;--.

Column 15, line 46, delete "support means".

UNITED STATES PATENT AND TRADEMARK OFFICE

CERTIFICATE OF CORRECTION

PATENT NO. : 5,848,501
DATED : December 15, 1998
INVENTOR(S) : Taipale et al.

It is certified that error appears in the above-identified patent and that said Letters Patent is hereby corrected as shown below:

Column 19, line 44, delete "section" and insert --sections--.

Column 19, line 56, delete "rotating" and insert --rotate--.

Signed and Sealed this

Seventeenth Day of August, 1999

*Attest:*

Q. TODD DICKINSON

*Attesting Officer*

*Acting Commissioner of Patents and Trademarks*